US009079329B2

(12) United States Patent
Koike

(10) Patent No.: US 9,079,329 B2
(45) Date of Patent: Jul. 14, 2015

(54) METHOD OF CUTTING A WOOD BLOCK AND VENEER LATHE

(75) Inventor: Masaru Koike, Obu (JP)

(73) Assignee: Meinan Machinery Works, Inc., Obu-shi (JP)

( * ) Notice: Subject to any disclaimer, the term of this patent is extended or adjusted under 35 U.S.C. 154(b) by 1190 days.

(21) Appl. No.: 12/926,440

(22) Filed: Nov. 18, 2010

(65) Prior Publication Data

US 2011/0114223 A1 May 19, 2011

(30) Foreign Application Priority Data

Nov. 19, 2009 (JP) ..... 2009-263497
Aug. 6, 2010 (JP) ..... 2010-176941

(51) Int. Cl.
*B27L 5/00* (2006.01)
*B27L 5/02* (2006.01)

(52) U.S. Cl.
CPC *B27L 5/027* (2013.01); *B27L 5/025* (2013.01)

(58) Field of Classification Search
CPC ..... B27L 5/006; B27L 5/008; B27L 5/02; B27L 5/025; B27L 5/04; B27L 5/027
USPC ..... 144/209.1, 210, 211, 212, 213, 214, 144/215, 215.5, 215.3, 215.4; 269/43, 45; 82/101, 162–164, 47
See application file for complete search history.

(56) References Cited

U.S. PATENT DOCUMENTS 4,744,397 A * 5/1988 Lorenzo ..... 144/213
5,141,038 A 8/1992 Nakaya
7,337,813 B2 * 3/2008 Koike ..... 144/332

FOREIGN PATENT DOCUMENTS

JP 11-268011 A 10/1999

OTHER PUBLICATIONS

European Search Report dated Feb. 9, 2012, issued for the corresponding European Patent Application No. 10191362.2.

* cited by examiner

*Primary Examiner* — Shelley Self
*Assistant Examiner* — Matthew G Katcoff
(74) *Attorney, Agent, or Firm* — Locke Lord LLP

(57) ABSTRACT

A method of cutting a wood block and a veneer lathe are disclosed. Two groups of first plural contact members and second plural contact members disposed around the wood block for supporting the wood block from the periphery thereof and each having a contact portion contactable with periphery of the wood block. The first and the second contact members are spaced away from each other along the spin axis of the wood block so as to form a space between any two adjacent contact members, respectively, and arranged in such a way that a part of the contact member of one group is insertable into the space between any two adjacent contact members of the other group when the wood block is cut to a predetermined reduced diameter so that the wood block is continued to be supported further.

9 Claims, 29 Drawing Sheets

METHOD OF CUTTING A WOOD BLOCK AND VENEER LATHE

BACKGROUND OF THE INVENTION

The present invention relates to a method of cutting a wood block by a veneer knife for peeling veneer therefrom and also to a veneer lathe.

Wood veneer used for manufacturing various wood products such as plywood and laminated veneer lumber (LVL) is produced by cutting or peeling a generally cylindrical wood block by a veneer lathe. As is well known in the art, the peeling is accomplished by moving the cutting edge of a veneer knife into the rotating wood block at a controlled feed rate. For improved veneer yield, it is important in veneer peeling operation that the wood block should be reduced to a core stock with as small diameter as possible while ensuring the strength of the wood block to resist external force applied thereto during the peeling operation. A veneer lathe is disclosed in U.S. Pat. No. 5,141,038 assigned to the same present assignee which is capable of cutting a wood block to a small diameter while preventing the wood block from being flexed or bent during the veneer peeling operation.

FIG. 28 is a schematic side view showing the above-identified veneer lathe. In the drawing, numeral 201 designates a knife carriage of the veneer lathe which is equipped with a veneer knife 205 having a cutting edge cutting into a wood block 207. The wood block is prepared by cross-cutting a log into the desired length. The knife carriage 201 has a pair of leadscrews 203 (only one being shown) each engaged with a leadscrew nut (not shown) having formed through an internal thread and connected to a servomotor 204 for driving its leadscrew 203 to rotate. The servomotor 203 is operable to rotate the leadscrew 203 reversibly in response to a signal from a control unit (not shown), thereby moving the knife carriage 201 toward and away from the wood block 207 as indicated by double-headed arrow. An absolute rotary encoder (not shown) is connected to the servomotor 204 for measuring or determining the current position of any part of the movable knife carriage 201, e.g. the cutting edge of the veneer knife 205 mounted on the knife carriage 201, with respect to a predetermined reference position of the veneer lathe. The use of this absolute rotary encoder makes possible determination of the distance r between the cutting edge of the veneer knife 205 and the spin axis of the wood block 207 that coincides with the axis of rotation of spindles when a wood block is supported by such spindles.

Numeral 209 designates veneer peeled from the wood block 207 by the veneer knife 205. Numeral 211 designates a number of drive discs (only one disc being shown) disposed adjacently to the cutting edge of the veneer knife 205 and juxtaposed in parallel relation to the spin axis of the wood block 207 for driving the wood block 207 from the periphery thereof. Each disc has formed on the outer periphery thereof a number of piercing projections engageable with the periphery of the wood block 207. The drive discs 211 are drive to rotate at a constant speed by a servomotor 213 via chains 215 in the direction that causes the wood block 207 to rotate in arrow direction through the engagement between the wood block 207 and the discs 211. Numeral 217 designates a plurality of nose bars (only one nose bar being shown) so as to press the periphery of the wood block 217 at a position immediately above the cutting edge of the veneer knife 205 for reducing lathe checks appearing in the surface of peeled veneer 209.

Numeral 219 designates a first roll disposed on the opposite side of the wood block 207 from the cutting edge of the veneer knife 205, freely rotatably supported by a holder (not shown) by way of a bearing (not shown either) and having such an axial length that the first roll 219 is contactable with the periphery of the wood block 207 over the entire length thereof. The holder for the first roll 219 is engaged with a leadscrew 221 driven to rotate by a servomotor 220 operable in response to a signal generated by the control unit (not shown) thereby to move the first roll 219 reversibly in horizontal directions as indicated by double-headed arrow. An absolute rotary encoder (not shown) is connected to the servomotor 220 for measuring the distance between the spin axis of the wood block 207 and the point at which the first roll 219 is in contact with the periphery of the wood block 207 during veneer peeling operation.

Numeral 223 designates a second roll freely rotatably supported by a holder (not shown) by way of a bearing (not shown either) and having substantially the same axial length as the first roll 219 so that the second roll 223 is contactable with the periphery of the wood block 207 over the entire length thereof. The second roll 223 has a diameter that is smaller than that of the first roll 219 and idle so that the roll 223 is driven to rotate by the contact with the wood block 207 being rotated. The holder for the second roll 223 is connected to a leadscrew 225 driven to rotate by a servomotor 224 operable reversibly in response to a signal generated by the control unit thereby to move the holder and hence the second roll 223 in vertical directions as indicated by double-headed arrow. An absolute rotary encoder (not shown) is connected to the servomotor 224 for determining the distance between the spin axis of the wood block 207 and the point at which the second roll 223 is in contact with the periphery of the wood block 207 during veneer peeling operation. A rotary encoder (not shown) is connected to the second roll 223 for determining the peripheral speed of the second roll 223 and hence the peripheral speed of the wood block 207 that drives the rotary encoder in contact therewith. This rotary encoder is connected to the control unit and generates to the control unit signals indicative of such peripheral speed.

In peeling veneer from the wood block 207 in the veneer late of FIG. 28, the movement of the knife carriage 201, the first roll 219 and the second roll 223 is controlled as follows. The distance r between the spin axis of the wood block 207 and the cutting edge of the knife 205 is provided by the absolute rotary encoder connected to the servomotor 204 and the peripheral speed x of the wood block 207 is provided by the rotary encoder for the second roll 223. Based on the distance r and the peripheral speed x, the control unit figures out the number of revolutions per unit time n of the wood block 207. Since the driving discs 211 are driven to rotate at a constant speed, the wood block peripheral speed n is also substantially constant.

Based on the information of the block speed n, the control unit generates signals to the servomotors 204 so that the knife carriage 201 is moved for a predetermined distance for each complete revolution of the wood block 207. Value r representing the distance between the spin axis of the wood block 207 and the cutting edge of the knife 205 is reduced progressively while the knife carriage 201 is moved toward the spin axis of the wood block 207. Since the peripheral speed x of the block speed 207 is constant, the speed at which the knife carriage 201 is moved is increased with a decrease of the distance r.

The control unit is operable to control the operation of the servomotor 220 for the leadscrew 121 in such a way that the contact point of the first roll 219 with the periphery of the wood block 207 is positioned at a distance r from the spin axis of the wood block 207 and such contact point is maintained while the knife carriage 201 is being moved toward the spin axis of the wood block 207 and the diameter thereof is being reduced progressively, accordingly. That is, the controlling is made so that the first roll 219 is kept in contact with the periphery of the wood block 207 by being moved horizontally in accordance with the movement of the knife carriage 201 toward the spin axis of the wood block 207.

The control unit is also operable to control the operation of the servomotor 224 for the leadscrew 225. The controlling is made in such a way that the contact point of the second roll 225 with the periphery of the wood block 207 is positioned at a distance r from the spin axis of the wood block 207 and such contact point is maintained while the knife carriage 201 is being moved toward the spin axis of the wood block 207. This is accomplished by moving the second roll 225 vertically in accordance with the movement of the knife carriage 201 toward the spin axis of the wood block 207.

In such veneer lathe, a wood block can cut into veneer having the desired thickness without being bent or flexed by any external force produced during the wood block cutting operation and also the wood block can be peeled down to a smaller core diameter than in the case when the wood block is cut while being supported by spindles, which greatly contributes to improvement of veneer yield.

In such veneer lathe, however, the second roll 223 is brought into an interference contact with the veneer knife 205, as shown in FIG. 29, or the first roll 219 may be moved into a damaging contact with the second roll 219 when the block cutting has proceeded and the wood block 207 has been reduced to a certain core diameter. Obviously, no further cutting can be performed and, therefore, no further improvement of veneer yield is achieved.

SUMMARY OF THE INVENTION

The present invention has been made in view of the above problem and, therefore, an object of the present invention is to provide a method of cutting a wood block and a veneer lathe which can cut a wood block to a smaller diameter than heretofore.

A method of cutting a wood block and a veneer lathe according to the present invention use two groups of a plurality of first contact members and a plurality of second contact members disposed around the wood block for supporting the wood block from the periphery thereof, as well as a knife carriage having a veneer knife with a cutting edge engageable with the wood block so as to cut thereinto and a wood block drive mechanism disposed adjacently to the cutting edge for driving the wood block to rotate from the periphery thereof. Each contact member has a contact portion contactable with periphery of the wood block. The first and the second contact members are spaced away from each other along the spin axis of the wood block so as to form a space between any two adjacent contact members, respectively, and arranged so that at least a part of the contact member of one group is insertable into the space between any two adjacent contact members of the other group. The contact member of the one group begins to enter into the space between any two adjacent contact members of the other group when the wood block is cut to a predetermined reduced diameter, so that the wood block cutting may be continued further until it is cut into a core with a still smaller diameter.

To permit the contact members to continue supporting the wood block which is being reduced in diameter by the cutting, the contact members of the two groups are moved at a controlled rate in conjunction with the cutting operation. According to the present invention, supporting of a wood block is done by maintaining the two groups of the first and the second contact members at such positions where the contact portions of the contact members lie on an imaginary spiral curve that extends from the cutting edge of the veneer knife in the direction in which the wood block is rotated for a distance corresponding to a substantially complete revolution of the wood block as seen in transverse section of the wood block, said imaginary spiral curve being a part of an imaginary Archimedean spiral which is determined by a predetermined distance moved by the knife carriage for each complete revolution of the wood block and represents a path of the cutting edge of the veneer knife as seen in transverse section of the wood block during wood block cutting.

According to the present invention, the wood block can be peeled down successfully to a core stick with an extremely small diameter, e.g. about 10 mm, which contributes greatly to the improvement of veneer yield.

Features and advantages of the present invention will become more apparent to those skilled in the art from the following description of embodiments of the invention, which description is made with reference to the accompanying drawings, wherein:

DETAILED DESCRIPTION OF THE EMBODIMENTS

The following will describe the first embodiment of veneer lathe according to the present invention with reference to FIGS. 1 through 14.

Figure 1:
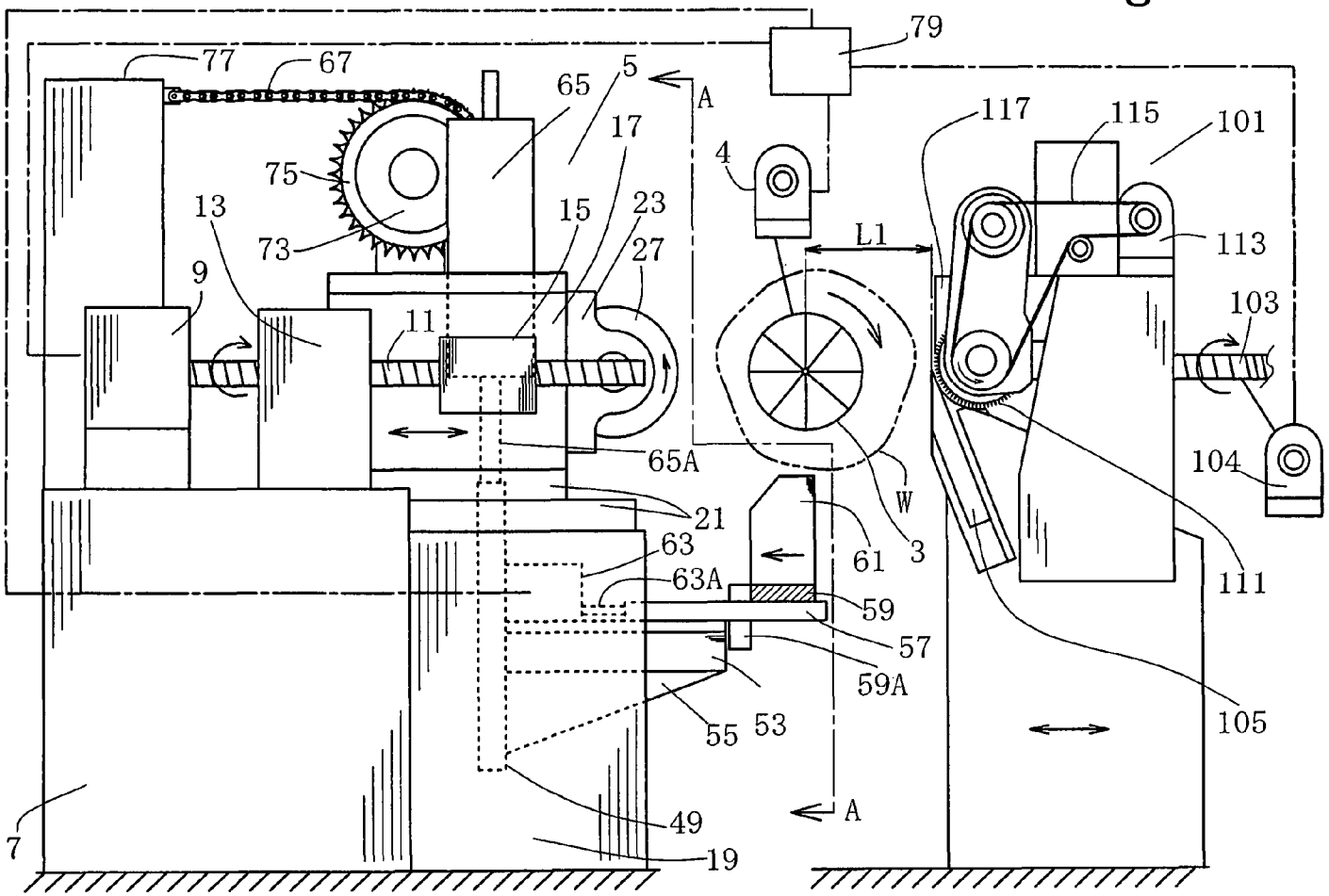
FIG. 1 is a side view showing a first embodiment of a veneer lathe according to the present invention.
Figure 28:
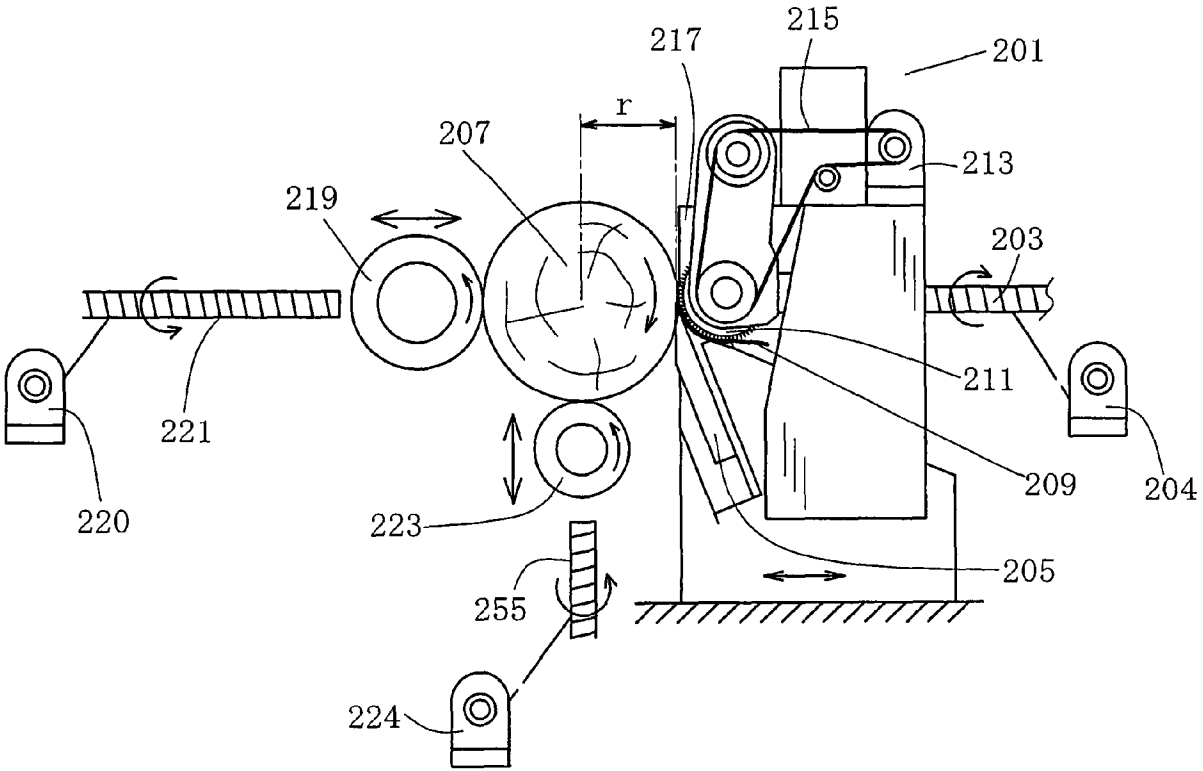
Fig. 28 PRIOR ART
FIG. 28 is a schematic side view of a rotary veneer lathe according to a background art.
Figure 29:
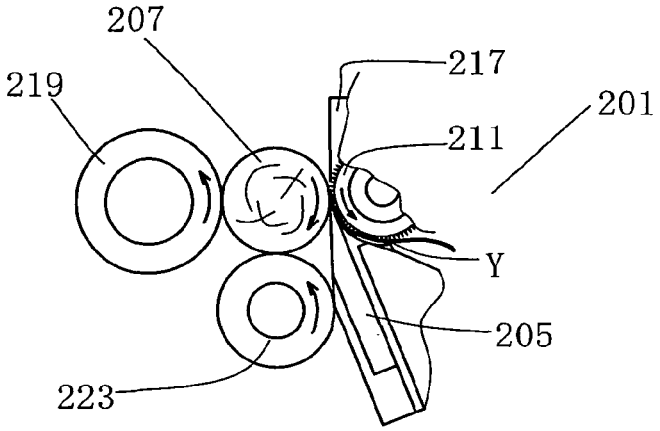
FIG. 29 PRIOR ART
FIG. 29 is a fragmentary side view of the rotary veneer lathe of FIG. 28, showing a different stage of veneer cutting operation.

Referring to FIG. 1, the veneer lathe includes a knife carriage 101. The knife carriage 101 is equipped with a veneer knife 105 having a cutting edge, a pair of leadscrews103, a servomotor 104 provided for each leadscrew 103 and having an absolute rotary encoder, a plurality of block driving discs 111, a chain 115, a servomotor 113 for driving the discs 111, and a plurality of nose bars 117, which are all substantially identical to their counterparts of the background art already described with reference to FIGS. 28 and 29.

Numeral 3 designates a pair of spindles (only one spindle being shown) movable reciprocally by hydraulic cylinders (not shown) toward and away from each other between their operative position where the spindles 3 are pressingly engaged with the opposite ends of a generally cylindrical wood block W (indicated by chain double-dashed line) for rotatably supporting and holding the wood block W therebetween and their retracted position where the spindles 3 are moved away from the opposite ends of the wood block W and also clear of the veneer knife 105 which has then moved very close to the spin axis Q of the wood block W. It is noted that a wood block W is prepared by cross-cutting a natural log to the desired length and also that the spin axis Q of the wood block W coincides with the axis of rotation of the spindles 3. The spindles 3 are connected to and driven by servomotors 4 so that the wood block W held between the spindles 3 is driven to rotate at a variable speed by the servomotors 4. A rotary encoder (not shown) is connected to one of the spindles 3 for measuring or determining the spindle speed in terms of the number of revolutions per unit time and generates an electrical signal indicative of such spindle speed to a control unit 79. The veneer knife 105 has a length that is slightly larger than the axial length of the wood block W.

Figure 2:
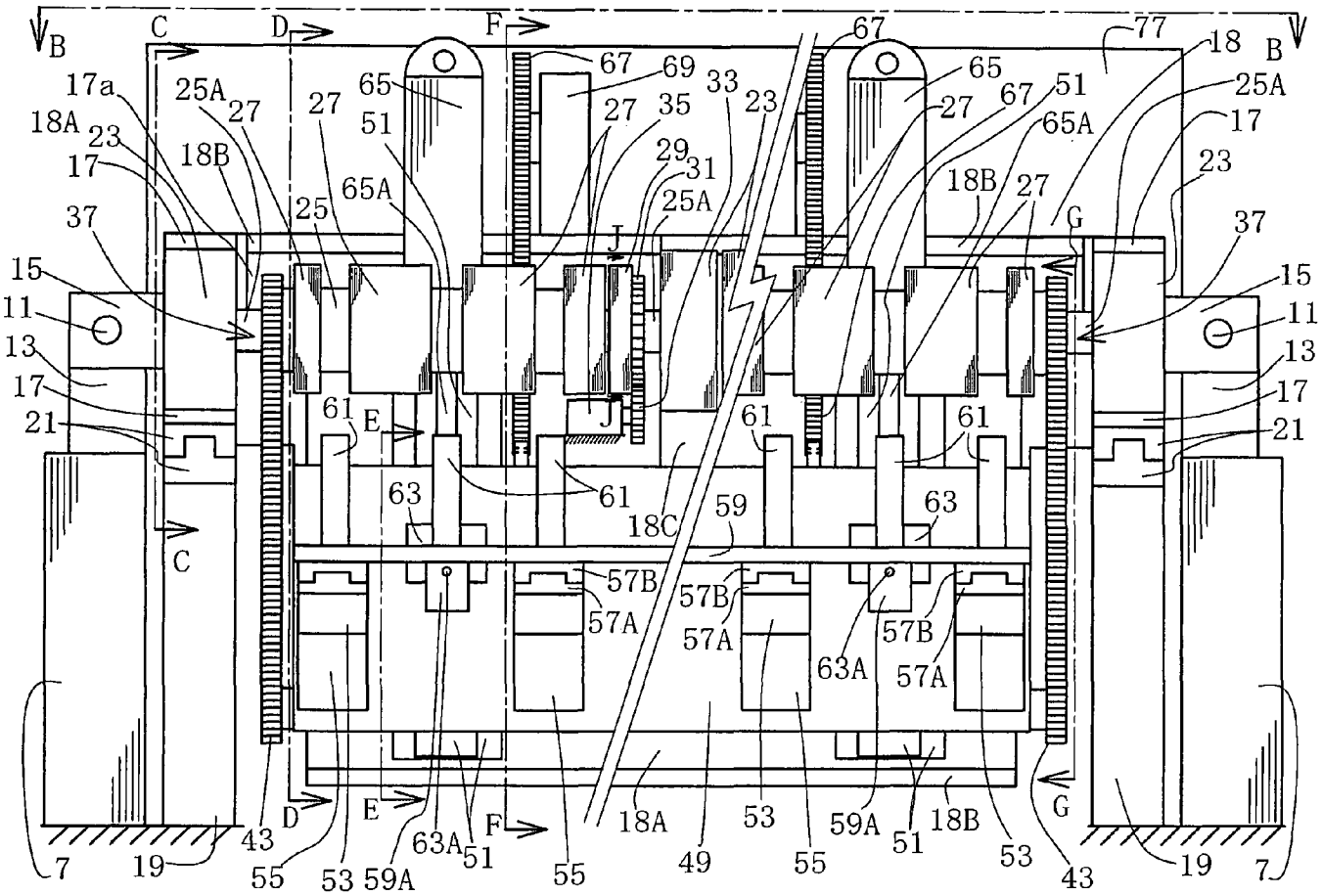
FIG. 2 is a front view as seen from line A-A of FIG. 1.
Figure 3:
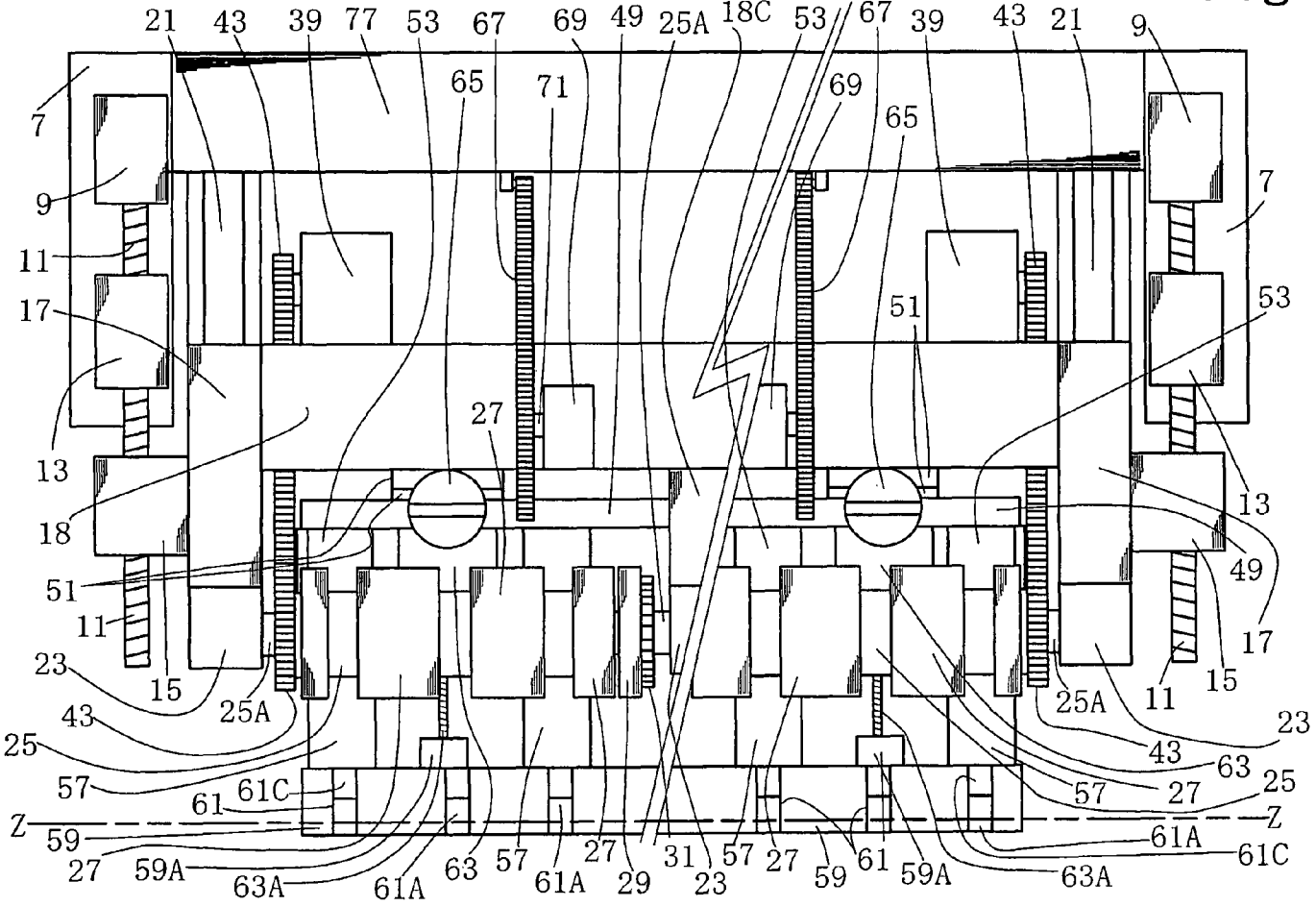
FIG. 3 is a plan view as seen from line B-B of FIG. 2.
Figure 4:
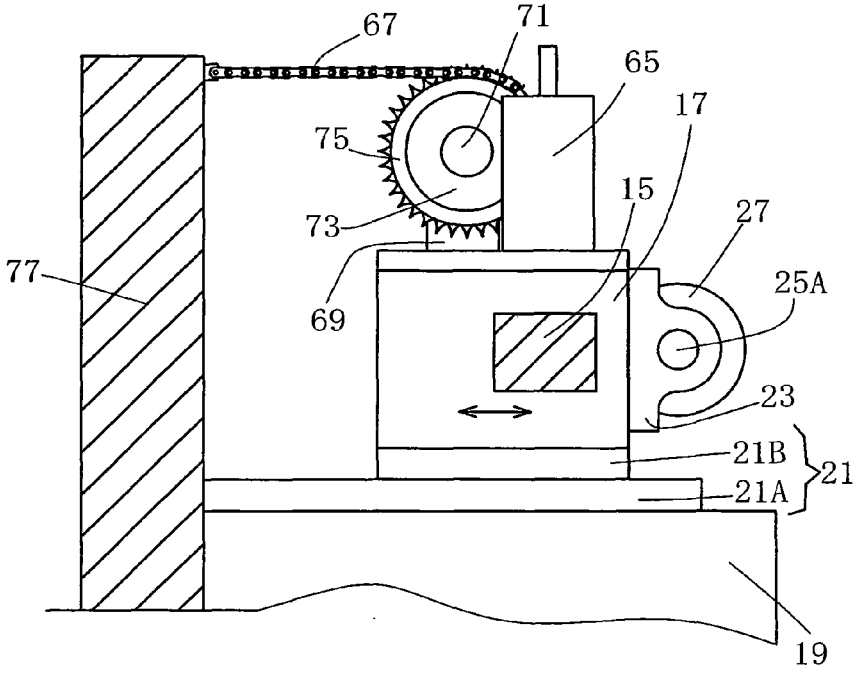
FIG. 4 is a partially sectional side view as seen from line C-C of FIG. 2.
Figure 5:
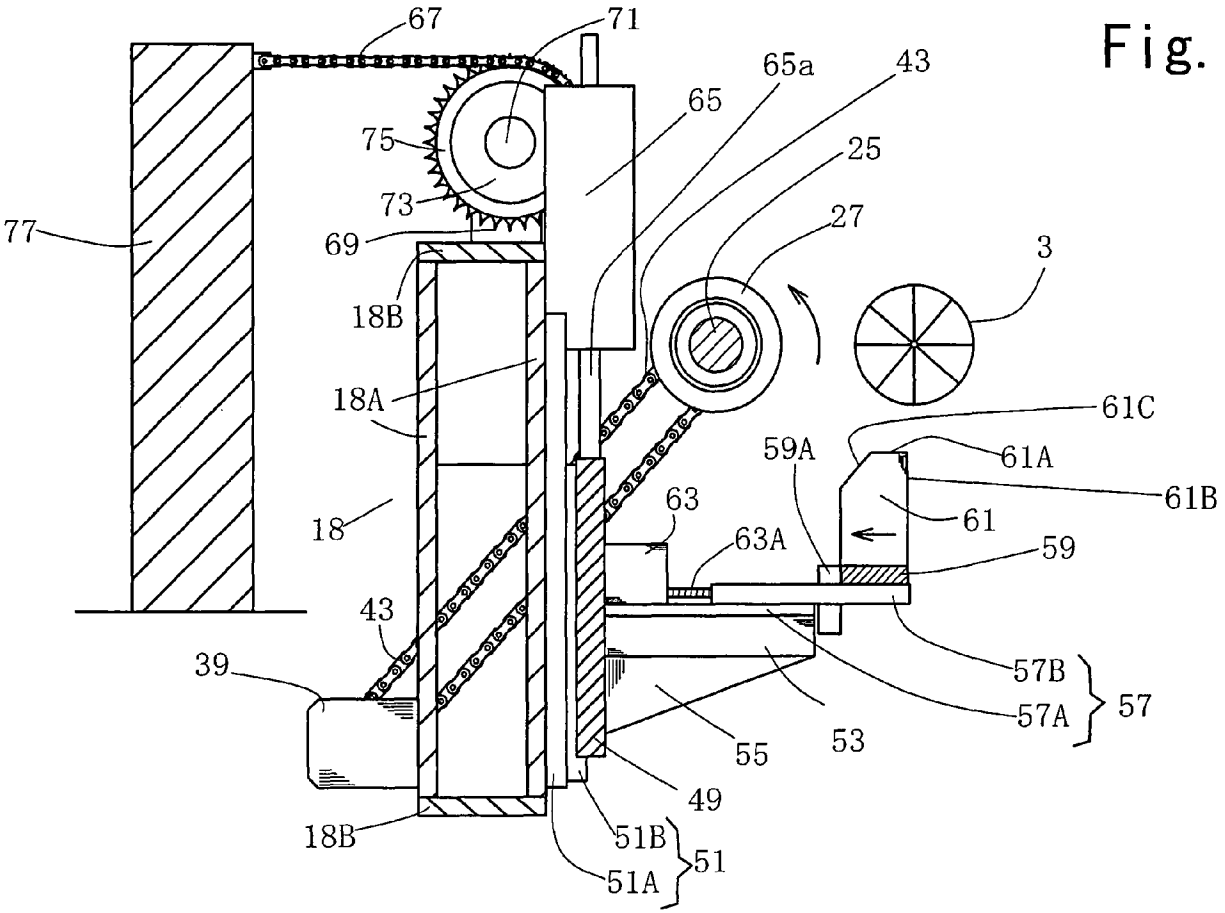
FIG. 5 is a partially sectional side view as seen from line D-D of FIG. 2.

The veneer lathe has a backup apparatus which is generally designated by numeral 5. The backup apparatus 5 includes a pair of stationary outer frames 7 disposed on opposite sides of the veneer lathe and a servomotor 9 mounted on each of the outer frames 7. Each servomotor 9 has an absolute rotary encoder (not shown) which will be described in detail in later part hereof. The backup apparatus 5 further includes a pair of leadscrews 11 connected to the servomotors 9 and rotatably supported by bearing units 13 fixedly mounted on the outer frames 7. Each leadscrew 11 is engaged with a leadscrew nut 15 having formed therethrough an internal thread. Numeral 19 designates a pair of stationary inner frames of the backup apparatus 5. A linear bearing 21 is mounted on each inner frame 19. As shown in FIG. 4, the linear bearing 21 has a stationary linear base 21A fixedly mounted to the inner frame 19 and a slide 21B movable relative to the base 21A. Numeral 17 designates a pair of backup carriages 17 fixedly mounted to the movable slides 21B of the linear bearings 21 for reciprocal movement therewith in double-head arrow directions (FIG. 1). The aforementioned leadscrew nut 15 is fixed to the outer wall of each backup carriage 17. As shown in FIGS. 2, 3 and 5, there is provided a movable box-shaped mounting frame 18 extending across the backup apparatus 5 and the paired backup carriages 17 are fixedly mounted to the opposite ends of the mounting frame 18. The mounting frame 18 is made of two vertical steel plates 18A and two horizontal steel plates 18B that are arranged and joined together into a box shape having a rectangular cross section.

Referring to FIGS. 2, 3 and 5, two rotatable shafts 25 are provided extending across the backup apparatus 5 between the backup carriages 17 and rotatably supported at the respective reduced opposite ends 25A thereof (FIG. 4) by bearing units 23. Specifically, each shaft 25 is supported by a pair of bearing units 23, one of which is fixed to the backup carriage 17 and the other of which is fixed to a mounting 18C (FIGS. 2, 3 and 7) formed integrally with the box-shaped mounting frame 18 at the center thereof and projecting therefrom toward the knife carriage 101.

A plurality of first rotatable contact members or backup rolls 27 is fixedly mounted on each of the shafts 25, e.g. by means of a key, for rotation therewith. The shafts 25 are disposed in the backup apparatus 5 such that the axis of rotation of the shafts 25, which coincides with the axis of rotation of the backup rolls 27, are level with the spin axis Q of a wood block W supported by the spindles 3. The backup rolls 27 are spaced along the shafts 25 at an interval so that a recessed space is formed between any two adjacent backup rolls 27 for receiving thereinto a second slide-type contact member or a backup block 61 which will be described in detail in later part hereof The circumferential periphery of the backup roll serves as the contact portion.

A ring member 29 having the same diameter as the backup roll 27 and a thickness that is smaller than that of the backup roll 27 is freely rotatably mounted on one of the shafts 25, or the left-hand side shaft 25 as seen in FIG. 2 in the illustrated embodiment, through a bearing (not shown) at a position adjacent to the inner end of the shaft 25 in rolling contact with the outer periphery of the wood block W. A gear 31 having a diameter that is smaller than that of the ring member 29 and fixed to the ring member 29 for rotation therewith is mounted on the same left-hand side shaft 25, as shown in FIG. 3. The gear 31 is engaged with a smaller gear 33 which is connected to a rotary encoder 35 determining the speed of the ring member 29 in terms of the number of revolutions per unit time and generating a detection signal representative of such speed of the ring member 29 to the control unit 79.

Chain double-dashed line Z-Z in FIG. 3 representing an imaginary line passing through the axis of rotation of the paired spindles 3 is provided for assisting in understanding of the arrangement of various parts and elements of the backup apparatus 5 with respect to the wood block W between the spindles 3.

Figure 8:
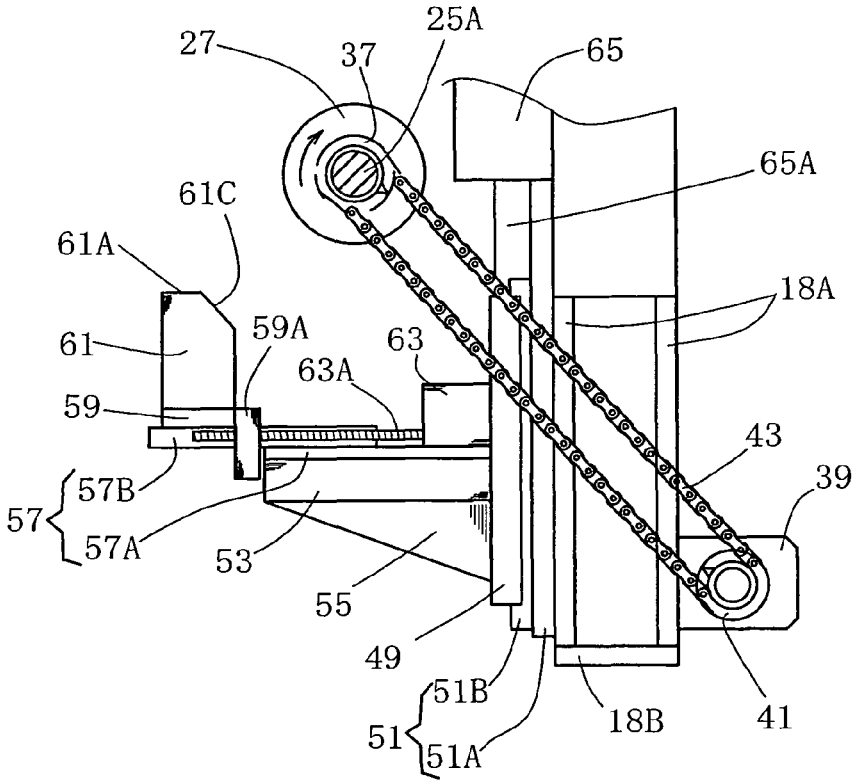
FIG. 8 is a partially sectional side view as seen from line G-G of FIG. 2.

Referring to FIG. 8, a sprocket wheel 37 is fixed on each shaft 25 at the outer end 25A thereof, e.g. by means of a key. As shown in FIGS. 3 and 5, a pair of motors 39 is fixedly mounted to the vertical plate 18A of the box-shaped mounting frame 18 at a position adjacent to the bottom thereof A sprocket wheel 41 is fixed on the output shaft of each motor 39 and an endless drive chain 43 is trained between the sprocket wheels 37 and 41, as shown in FIG. 5, so that the backup rolls 27 are driven to rotate in arrow direction by the motors 39 through the chains 43.

Figure 9:
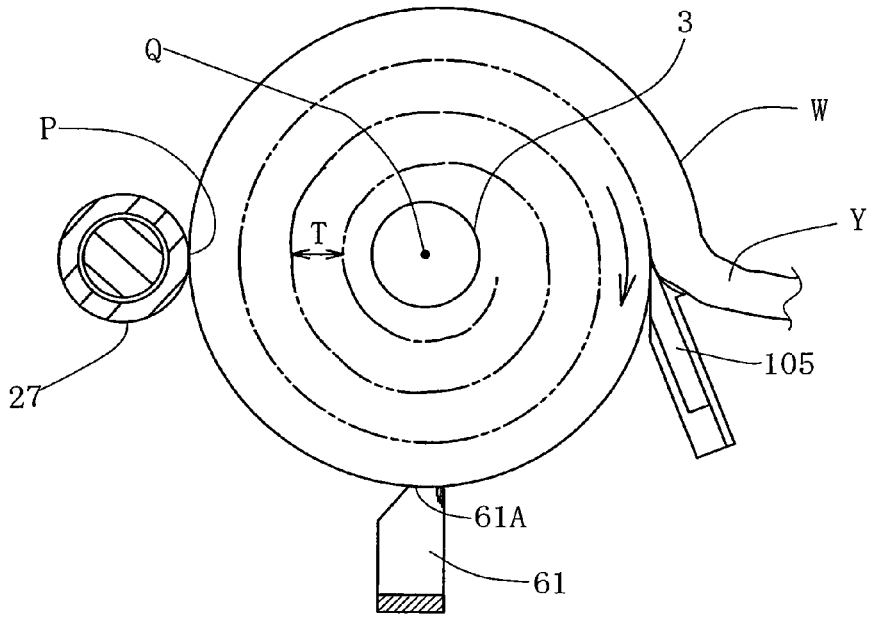
FIG. 9 is a schematic view illustrating a wood block being cut by the cutting edge of veneer knife of the veneer lathe while being supported by contact members.

In the above-described arrangement of the backup apparatus 5, rotating the leadscrews 11 reversibly by the servomotors 9, the backup carriages 17 and the box-shaped mounting frame 18 are moved horizontally relative to the outer and inner frames 7 and 19 toward and away from the knife carriage 101 in double-headed arrow directions shown in FIG. 1. As indicated earlier, each servomotor 9 has an absolute rotary encoder (not shown) for determining the current position of the backup carriage 17 and hence of the backup rolls 27. To be more precise, the absolute rotary encoder for the servomotor 9 determines the position of point of contact P of the backup rolls 27 with the periphery of a wood block W being cut by the veneer knife 105, as shown in FIG. 9, and generate a detection signal indicative of such position to the control unit 79.

Referring to FIGS. 2, 3 and 5, numeral 51 designates a plurality of linear bearing 51 each disposed in vertical position (FIG. 5) and having a stationary linear base 51A fixed to the movable box-shaped mounting frame 18 and a slide 51B movable vertically relative to the base 51A. As shown in FIGS. 1, 3 and 5, a vertical support block 49 is fixedly mounted to the movable slide 51B of the linear bearings 51 for vertical movement therewith relative to the mounting frame 18 and to the backup carriage 17.

A plurality of horizontal mounting blocks 53 is fixed to the support block 49 and extends from the support block 49 toward the knife carriage 101, as shown in FIG. 1. The mounting blocks 49 are spaced at an interval in the axial direction of a wood block W held by the spindles 3. Each mounting block 53 is reinforced by a rib 55 against a force acting downward. As shown in FIGS. 1, 2 and 5, there is provided a plurality of linear bearings 57 each disposed in horizontal position and having a stationary linear base 57A fixed to the top surface of the mounting block 53 and a movable slide 57B. The linear bearings 57 are provided at positions corresponding to the aforementioned spaces each formed between any two adjacent backup rolls 27.

Figure 6:
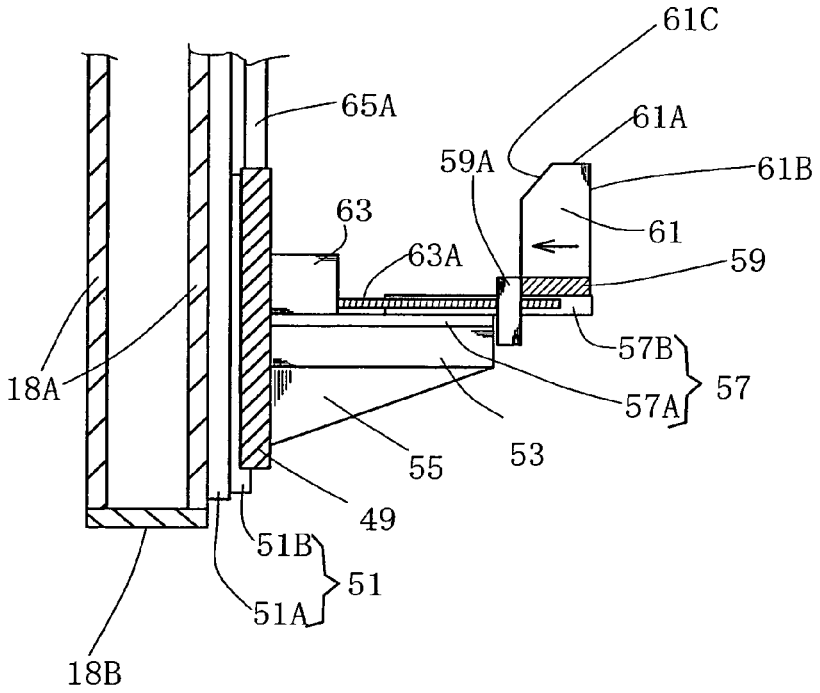
FIG. 6 is a partially sectional side view as seen from line E-E of FIG. 2.

A horizontal plate 59 having a length spanning all the movable slides 57B of the linear bearings 57 (FIG. 2) and a width (FIG. 5) is fixedly mounted to the movable slides 57B at the forward ends thereof for linear movement with the slides 57B. As shown in FIGS. 5 and 6, a pair of vertical plate 59A each having formed therethrough in horizontal direction an internal thread (not shown) is fixed to the horizontal plate 59 on the side thereof opposite from the knife carriage 11. A leadscrew 63A (FIGS. 2 and 5) extends through each vertical plate 59A in engagement with its internal thread.

As shown in FIGS. 2 and 5, a plurality of second slide-type contact members or backup blocks 61 is fixedly mounted on the plate 59. Each backup block 61 has a horizontal top surface 61A serving as the contact portion, a vertical surface 61B, a cutaway or the surface 61C inclined downwardly away from the knife carriage 101 and a width (shown in FIG. 2) as measured along the spin axis Q of a wood block W held between the spindles 3 that is slightly smaller than the recessed space formed between any two adjacent backup rolls 27. As shown in FIG. 2, the backup blocks 61 are disposed at positions corresponding to the recessed spaces between any two adjacent backup rolls 27. That is, the backup blocks 61 are also spaced along the spin axis Q of the wood block W so that a space is formed between any two adjacent backup rolls 61.

In FIGS. 1, 5 and 6, two servomotors 63 are fixedly mounted to the support block 49 on the side thereof facing the knife carriage 101. The aforementioned leadscrews 63A are connected at one end thereof to the respective servomotors 63 and, as indicated earlier, engaged with the internal thread formed through formed through the vertical plate 59A, so that the rotation of the leadscrews 63A by the servomotors 63 causes the slides 57B of the linear bearings 57 and hence the backup blocks 61 to move reversibly in horizontal direction relative to the mounting blocks 53. Each servomotor 63 is operable in response to a signal form the control unit 79 and has an absolute rotary encoder (not shown) for determining the current position of the backup blocks 61 and generating signals indicative of such position to the control unit 79.

Figure 7:
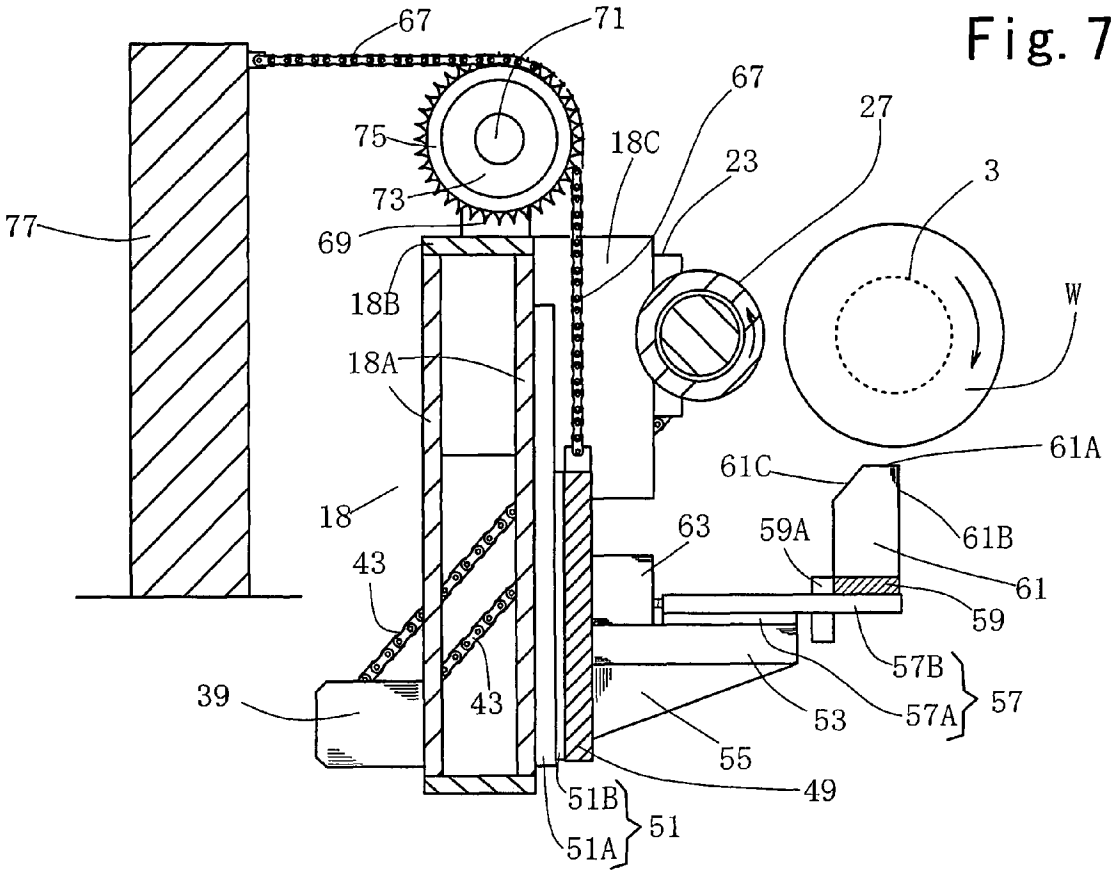
FIG. 7 is a partially sectional side view as seen from line F-F of FIG. 2.

Numeral 65 (e.g. FIGS. 1, 2 and 5) designates a plurality of air cylinders fixed to the vertical plate 18A of the box-shaped mounting frame 18 at a spaced interval in the axial direction of a wood block W held between the spindles 3. Each air cylinder 65 is supplied constantly with air of a predetermined pressure through air tube (not shown), so that the lower end of the piston rod 65A of the air cylinder 65 is pressed against the top of the support block 49 with a predetermined pressure. Numeral 67 (e.g. FIGS. 5 and 7) designates a plurality of chains each connected at one end thereof to the upper part of a frame member 77 which is fixed at the bottom thereof to the outer frame 7 and at the other end thereof to the top end of the support block 49. As shown in FIG. 7, the chain 67 is engaged with a sprocket wheel 75 which is freely rotatably supported on a shaft 71 through a bearing 73. A support member 69 is fixedly to the top of the plate 18B of the box-shaped mounting frame 18 and the shaft 71 is freely rotatably supported by the support member 69 through a bearing 73.

The movement of the backup carriages 17 and the support blocks 49 connected to the chains 67 will be briefly explained in the following. In cutting a wood block W to peel veneer Y with a thickness T (FIG. 9), the backup carriages 17 are moved while being guided by the linear bearings 21 toward the wood block W at a controlled speed by the servomotors 9 in response to a control signal from the control unit 79. As a result, the box-shaped mounting frame 18 to which the backup carriages 17 are fixed is moved away from the frame member 77 together with the backup carriages 17, as readily understood from FIG. 7. Since the chain 67 has a fixed length, the horizontal movement of the backup carriage 17 away from the frame member 77 causes the support block 49 to move vertically upward along the linear bearings 51 for substantially the same distance as the distance moved by the backup carriages 17 in horizontal direction.

Reference is now made to the schematic view of FIG. 9 showing a wood block W being rotated in arrow direction on its spin axis Q and cut by the veneer knife 105 into veneer Y with a thickness T together with the backup roll 27 and the backup block 61 which are positioned to support the wood block W at two different positions. The chain double-dashed spiral curve is an imaginary Archimedean spiral along which the cutting edge of the veneer knife 105 moves relative to the wood block W in peeling veneer Y with the thickness T as seen in transverse section of the wood block W. The Archimedean spiral is determined by the distanced moved by the veneer knife 105 toward the spin axis Q of the wood block W for each complete revolution of the wood block W that corresponds to the thickness T of veneer Y. The outermost spiral curve indicated by solid line is also an imaginary line that is a part of the Archimedean spiral and extends from the cutting edge of the veneer knife 105 as seen in transverse section of the wood block W in the direction in which the wood block W is rotated (or clockwise direction as seen in FIG. 9) for a distance corresponding to a substantially complete revolution of the wood block W. FIG. 9 shows a state wherein a point in the circumferential periphery of the backup roll 27 and the top surface 61A of the backup block 61 lie on the outermost solid curved line, respectively. In the state of FIG. 9, when the wood block W has been substantially rounded, the above imaginary spiral curve indicated by the solid line corresponds to the peripheral surface of the wood block W and the backup roll 27 is in rolling contact at the point P with the periphery of the wood block W and the backup block 61 is in sliding contact at the top surface 61A thereof with the same periphery of the wood block W, respectively. It is noted that the thickness T of veneer Y is shown exaggerated for clarity.

Turning back to the chain 67, the length of the above chain 67 is set such that the positional relation among the veneer knife 105, the backup roll 27 and the backup block 61 shown in FIG. 9 is maintained while the backup carriages 17 are being moved toward the spin axis Q of the wood block W during veneer peeling operation. Obviously, the length of the chain 67 needs to be changed whenever the thickness T of veneer Y to be peeled is changed for ensuring the positional relation of FIG. 9. For example, the frame member 77 may be formed therein with an internally threaded hole and the chain 67 has at the end thereof adjacent to the frame member 77 a screw engageable with the internal thread in the frame member 77 so that the length of the chain 67 is changed by screwing the screw in or out of the internally threaded hole.

As mentioned earlier, the air cylinders 65 are supplied constantly with air under a predetermined pressure through the air tubes. This pressure is set weak enough not to hamper the upward movement of the support blocks 49, but strong enough to push down the support block 49 when cutting of a wood block W is finished and the backup carriage 17 is moved away from the knife carriage 101 for receiving a new wood block.

The knife carriage 101, the backup rolls 27 and the backup blocks 61 are thus arranged around a wood block W being cut by the veneer knife 105. The control unit 79 is operable to control the operation of the respective equipment and devices based on detection signals received from various instruments and devices.

The following will describe the operation of the above-described veneer lathe with reference to FIGS. 10 through 14.

Prior to cutting a wood block W by the veneer lathe, the lathe operator enters data of the desired thickness of veneer to be peed from a wood block W into the control unit 79 and also makes an initial setting of the veneer lathe, if necessary, by adjusting the length of the chain 67 in accordance with the desired veneer thickness. The motor 113 for driving the discs 111 may be previously started.

Wood block W is held at the center of the opposite ends thereof between the paired spindles 3. Since each wood block having various irregularities on the periphery is not smoothly cylindrical, moving parts of the veneer lathe such as the knife carriage 101, the backup rollers 27 and the backup blocks 61 are initially positioned so that they will make no physical interference with the wood block W when it is rotated on its spin axis Q.

Specifically, the lathe operator manually operates the servomotors 104 to move the knife carriage 101 away from the wood block W (rightward as seen in FIG. 1) to a position where the cutting edge of the veneer knife 105 on the knife carriage 101 is sufficiently clear of the periphery of the wood block W when it is rotated. In conjunction with the movement of the knife carriage 101, the control unit 79 automatically generates signals to the servomotors 9 and 63 to move the backup rollers 27 and the backup blocks 61 to the positions where they are placed in such a positional relation with respect to the cutting edge of the veneer knife 105 as shown in FIG. 9. Specifically, the backup rolls 27 and the backup blocks 61 are moved to positions where they are clear of the wood block W and the circumferential periphery of the backup rolls 7 and the top surfaces 61A of the backup blocks 61 lie on an imaginary spiral curve that is a part of an imaginary Archimedean spiral as described with reference to FIG. 9.

With the knife carriage 101, the backup rolls 27 and the backup blocks 61 thus set in their initial positions, the lathe operator manually sends a signal to the control unit 79 to start cutting of the wood block W. Receiving such signal, the control unit 79 generates signals to start the servomotors 4, 104, 9 and 63, respectively. As a result, the wood block W is driven to rotate on its spin axis Q in arrow direction (FIG. 1), the veneer knife 105 on the knife carriage 101 is fed into the wood block W and the backup carriages 17 are moved toward the spin axis Q of the wood block W. While the knife carriage 101 is moving, the control unit 79 constantly receives a signal indicative of the current distance between the cutting edge of the veneer knife 105 and the spin axis Q of the wood block W that substantially corresponds to the current radius of the wood block W from the absolute rotary encoders connected to the servomotors 104. The control unit 79 receiving information of such distance generates to the servomotors 4 a control signal that changes the speed of the spindles 3 in such a way that the peripheral speed of the wood block W at the cutting edge of the veneer knife 105 becomes substantially equal to the peripheral speed of the wood block driving discs 111.

Receiving information of the rotating speed of the spindles 3 from the rotary encoder connected to one of the spindles 3, the control unit 79 calculates the time that is required for the spindles 3 to make a complete revolution and controls the operation of the servomotor 104 so that the knife carriage 101 and hence the veneer knife 105 is moved toward the spin axis Q of the wood block W for a distance corresponding to the desired thickness T of veneer Y to be peeled in the time during which the spindles 3 or the wood block W makes a complete revolution. The position of the knife carriage 101 is monitored by the absolute rotary encoder in the spindle drive servomotor 4 for feedback controlling the movement of the knife carriage 101.

The control unit 79 also generates to the servomotors 9 a control signal which causes the backup carriages 17 to move for the distance corresponding to the veneer thickness for each complete revolution of the spindles 3 toward spin axis Q of the wood block W. The distance moved by the backup carriages 17 is monitored by the absolute rotary encoders of the servomotors 9 and the information of such distance is sent for the control unit 79 for feedback controlling of the servomotors 9.

In accordance with the movement of the backup carriage 17 with the backup rolls 27 toward the spin axis Q of the wood block W, the support block 49 for the backup block 61 is lifted or moved upward relative to the backup carriages 17 by the chain 67.

When the backup carriages 17 are continued to move toward the spin axis Q of the wood block W, the backup blocks 61 connected to the backup carriages 17 by way of the mounting blocks 53, support block 49, chains 67 and sprocket wheels 75 are moved toward the knife carriage 101 and away from the position just below the spin axis Q of the wood block W. In order to compensate for such movement, the control unit 79 responding to signals from the absolute rotary encoder for the servomotors 9 simultaneously operates the servomotors 63 to rotate in such a way that causes the backup blocks 61 to move away from the knife carriage 101 for the same distance as the support blocks 61 are moved toward the spin axis Q of the wood block W. As in the case of the servomotors 9, this movement of the backup blocks 61 is feedback controlled based on signals generated by the rotary encoder in the servomotors 63.

As a result, during veneer peeling operation when the veneer knife 105 continues to cut into a rotating wood block W for peeling veneer Y therefrom, as shown in FIG. 9, the cutting edge of the veneer knife 105, the point of contact P of the backup rolls 27 with the periphery of the wood block W and the surface of contact of the top surfaces 61A of the backup blocks 61, as seen in transverse section of the wood block W, maintain the same positional relation with respect to an imaginary spiral curve of an Archimedean spiral (FIG. 9), while moving closer to each other.

As mentioned above, wood blocks W which are prepared by cross-cutting a log into any desired lengths are not smoothly cylindrical, but have various irregularities on their peripheral surface. In the early stage of cutting when the wood block W held at the opposite ends thereof is driven to rotate by the spindles 3 and the driving discs 111, the veneer knife 105 makes actual cutting intermittently because of the presence of various irregularities on the block peripheral surface and, therefore, irregularly shaped veneer strips are cut from the wood block W. The backup rolls 27 and the top surfaces 61A of the backup blocks 61 support the rotating wood block W while being in intermittent contact with the periphery of the wood block W intermittently.

Figure 10:
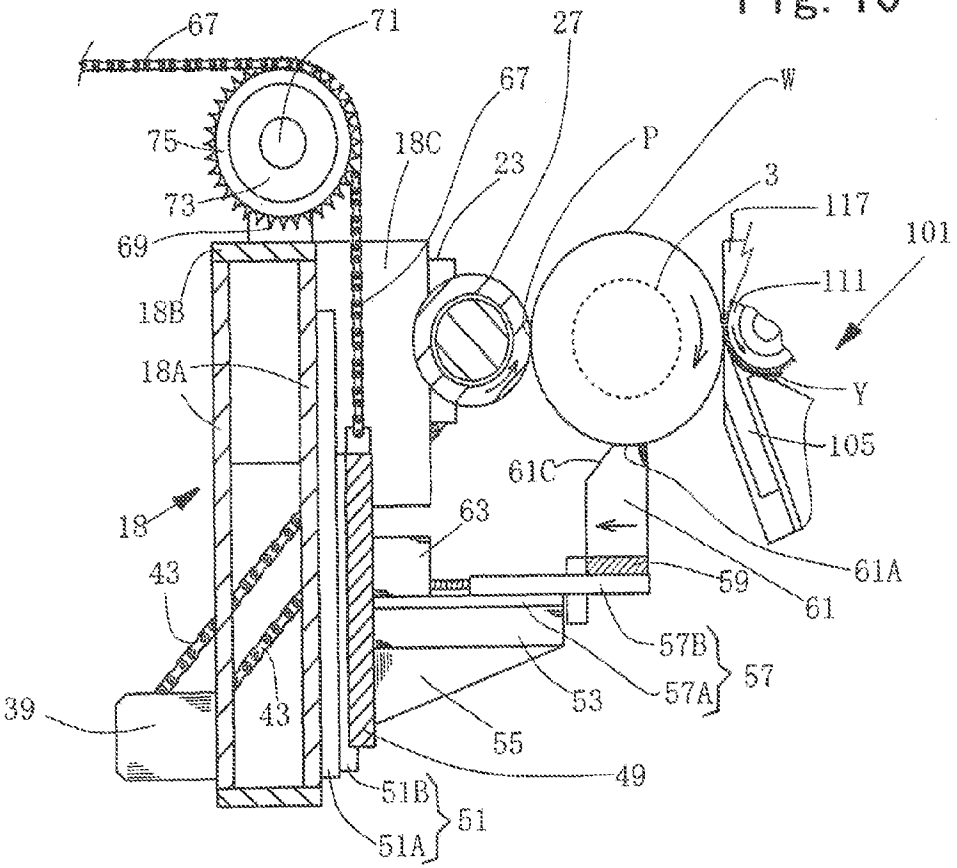
FIGS. 10 through 14 are side views showing different stages of a wood block being cut by the veneer knife of the veneer lathe of FIG. 1.

As the cutting proceeds, the wood block W supported by the spindles 3 is rounded or becomes smoothly or substantially cylindrical, as shown in FIG. 10, and a continuous ribbon of veneer Y is peeled from the wood block W, accordingly. After the wood block W has been thus rounded, the backup rolls 27 and the backup blocks 61 support the wood block W while being in continuous contact with the periphery of the wood block W and maintaining the same positional relation as that shown in FIG. 9.

Figure 11:
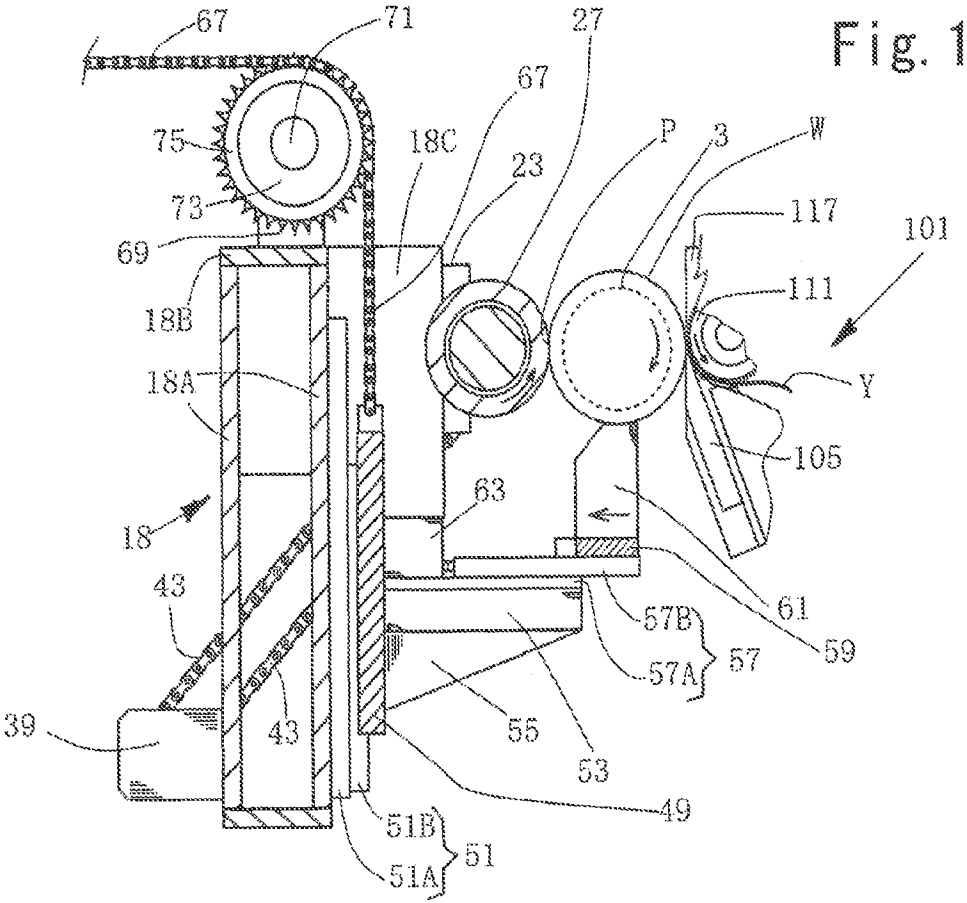

As the cutting further proceeds, the diameter of the wood block W is reduced to a predetermined extent, as shown in FIG. 11, where the cutting edge of the veneer knife 105 has moved very close to the spindles 3 just before a physical interference therebetween occurs if the cutting is continued as it is. Such position of the cutting edge of the veneer knife 105 is detected by the absolute rotary encoders provided in the servomotors 104 for the knife carriage 101. In response to a signal indicative of such position from the absolute rotary encoders, the control unit 79 causes the spindles 3 to move away from the wood block ends to their retracted position by deactivating the hydraulic cylinders for the spindles 3. Veneer peeling operation is continued with the wood block W then supported by the driving discs 111, backup rolls 27 and the backup blocks 61 and driven to rotate only by the driving discs 111.

In this state in which the spindles 3 are moved to their retracted positions and, therefore, no interference occurs between the veneer knife 105 and the spindles 3 by further infeeding movement of the veneer knife 105, cutting of the wood bloc W for veneer peeling can be continued successfully. During the further cutting of the wood block W, the cutting edge of the veneer knife 105 carried by the knife carriage 101, the backup rollers 27 and the backup blocks 61 carried by the backup carriages 17 are moved toward the spin axis Q of the wood block W while maintaining the positional relation with respect to the imaginary spiral curve as mentioned earlier with reference to FIG. 9.

With the spindles 3 placed in their retracted position away from the wood block ends, the time required for the wood block W to make a complete revolution cannot be measured any more by the rotary encoder connected to one of the spindles 3. After the spindles 3 have been retracted, the ring members 29 set in rolling contact with the periphery of the wood block W measures the time required for the wood block W to make a complete revolution. That is, the control unit 79 receives information of the speed of the ring member 29 in terms of the number of revolutions per unit time that is determined by the rotary encoder 35 connected to ring member 29 through the gears 33 and 31 and of the distance between the contact point P of the backup roller 27 with the peripheral surface of the wood block W and the spin axis Q of the wood block W that is determined by the absolute rotary encoders connected to the servomotors 9. The control unit 79 calculates the peripheral speed of the wood block W from the speed of the ring member 29 and the circumferential length of the wood block W from the above distance, respectively, and figures out the time required for the wood block W to make a complete revolution by dividing the circumferential length by the peripheral speed. Based on the above time for the wood block W to make a complete revolution that is reduced progressively as the progress of wood block cutting, the control unit 79 controls the movement of the knife carriage 101 and the backup carriage 17 by controlling the operation of the respective servomotors 104 and 9 so that the knife carriage 101 and the backup carriage 17 are moved at the controlled rate. Thus, veneer Y with the desired thickness T continues to be peel from the wood block W. During such stage of wood block cutting, the control unit 79 controls the operation of the servomotor 63 such that sliding contact between the top surface 61A of the backup blocks 61 and the periphery of the wood block B is maintained at a position just below the spin axis Q of the wood block.

Figure 12:
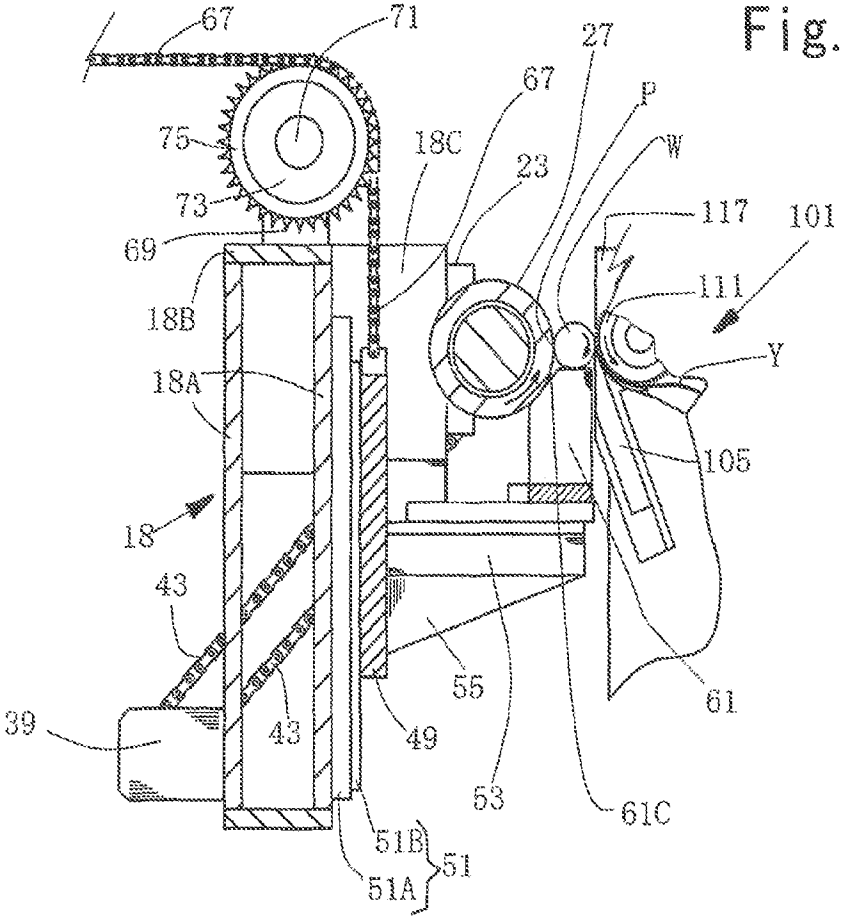

As the cutting still further proceeds and the diameter of the wood block W is further decreased to an extent as shown in FIG. 12, the backup block 61 begin to enter into a space between any two adjacent backup rolls 27. The diameter of the wood block W at which the entry of the backup block 61 into the space begins occur varies according to the diameter of the backup roll 27 and the shape of the backup block 61. It is noted that the periphery of a wood block W being cut by the veneer knife 105, as viewed in transverse section, is not precisely circular, but a spiral curve that is a part of an imaginary Archimedean spiral as described with reference to FIG. 9, but the term of diameter is used for the sake of explanation.

Figure 13:
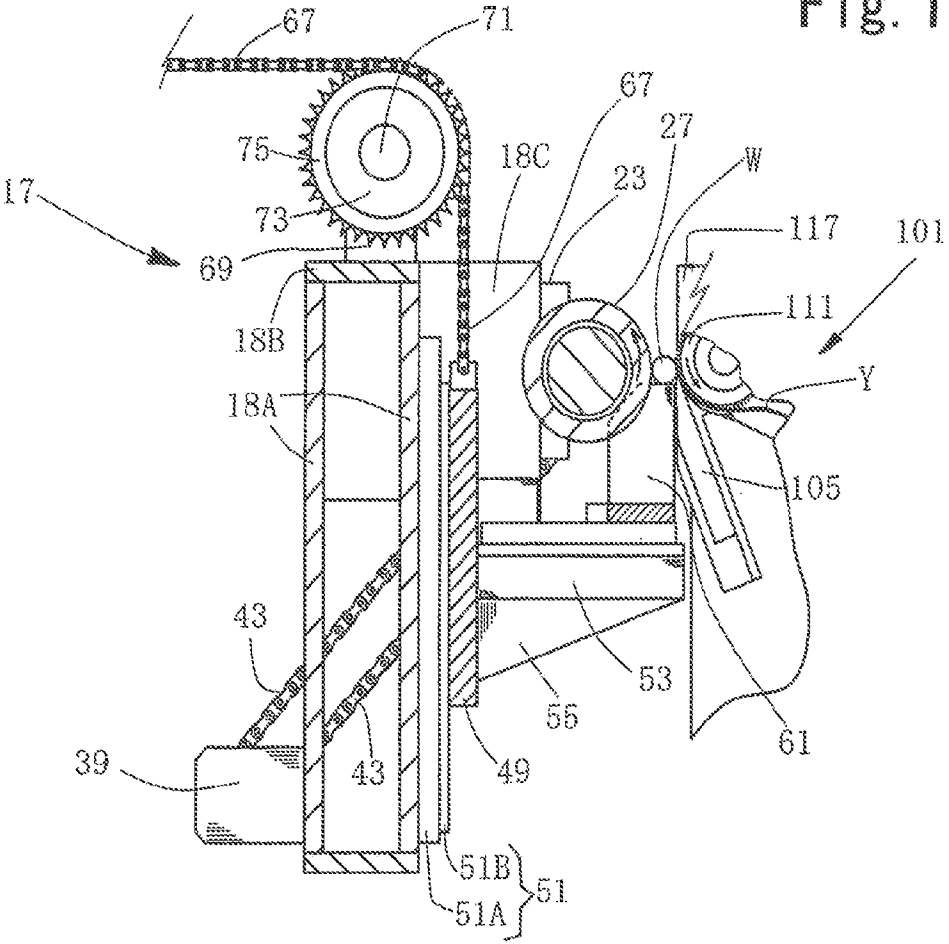

When the diameter of the wood block W is further reduced from the state of FIG. 12, the backup blocks 61 begins to enter into the space between any two adjacent backup rolls 27, with the result that the wood block W continues to be cut into veneer Y while being supported successfully by the peripheral surfaces of the backup rolls 27 and the top surfaces 61A of the backup blocks 6. Because the surface 61B of the backup block 61 adjacent to the veneer knife 105 is formed vertical relative to the top surfaces 61A, the backup blocks 61 are less liable to contact with any part of the knife carriage 101 such as the veneer knife 105. For allowing the cutting edge of the veneer knife 105 to move as close as possible to the spin axis Q of the wood block W so as to reduce the wood block W to a core with a diameter as small as possible, the movement of the backup block 61 leftward as seen in FIG. 11 by the servomotors 63 is so controlled that the position of the top surface 61A of the backup block 61 relative to the spin axis Q of the wood block W is shifted slightly leftward when the wood block W is cut a small-diameter core, e.g., as shown in FIG. 13. Additionally, the presence of the cutaway 61C permits the backup block 61 to enter into its corresponding space deeper than in a case no such cutaway is formed in the backup block 61. Thus, the wood block W can be peeled down successfully to a core stick with an extremely small diameter, e.g. about 10 mm, which contributes greatly to the improvement of veneer yield.

Figure 14:
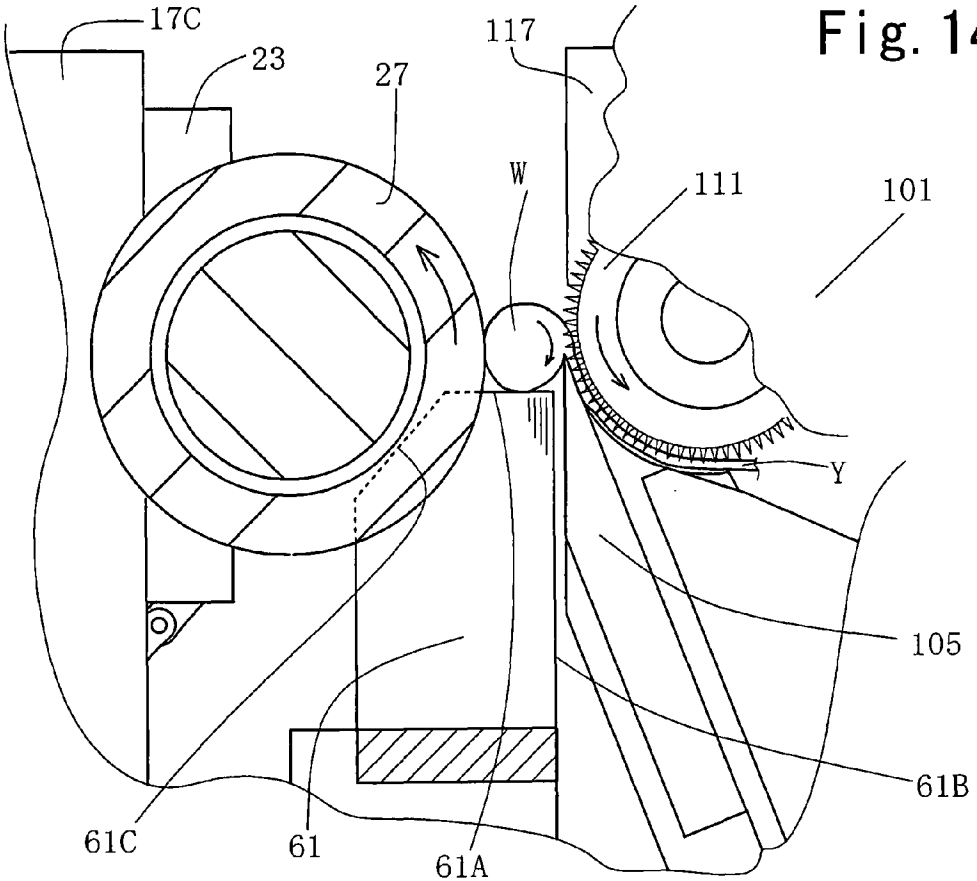

When the wood block W is further cut and the absolute rotary encoders of the servomotors 104 determine that the knife carriage 101 has moved to the position shown in FIG. 14, the control unit 79 stops the operation of the servomotors 104 for the knife carriage 101, the servomotor 113 for the driving discs 111, the servomotors 9 for the backup carriages 27 and the servomotor 63 for the backup blocks 61, respectively, and the operation of cutting a wood block W by the veneer lathe is finished.

Subsequently, the knife carriage 101 and the backup carriages 17 are moved back to their retracted positions by reversing their associated servomotors. In retracting the backup carriers 17, the support block 49 receives no more lifting force by the chain 67, but receives only relatively weak force acting downward by the piston rods 65A of the air cylinders 65. Therefore, the support block 49 moved to a position adjacent to the upper part of the box-shaped mounting frame 18 can be lowered easily back to its original position. The chain 67 which is then tensioned by the force from the air cylinders 65 can be moved smoothly without being disengaged from the sprocket wheel 75. In cutting a new wood block W, the above steps of operation will be repeated.

The following will describe various modifications according to the present invention.

The backup block 61 as the second contact member arranged in sliding contact with the periphery of a wood block W in the first embodiment may be replaced with a roll type contact member freely rotatably supported by any suitable bearing such as the backup roll 27. In this case, the roll type contact member should be made with a diameter as small as possible so that it may not be brought into contact with any part of the knife carriage 101 such as the veneer knife 105 before the wood block W is cut to any desired small diameter.

The backup rolls 27 and the backup blocks 61 in the above-described first embodiment may be replaced with two sets of backup rolls that are disposed such that each backup roll in one set is positioned in a space between any two adjacent rolls of the other of set backup rolls and made in such a unit that relative position between the two sets of rolls remains unchanged and the rolls are movable as a unit.

Figure 15:
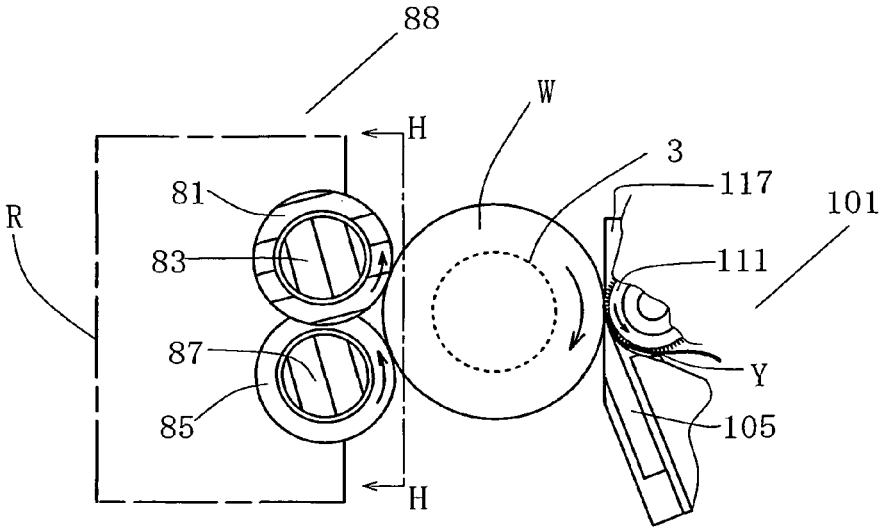
FIG. 15 is a fragmentary side view showing a modified embodiment of a veneer lathe according to the present invention.
Figure 16A:
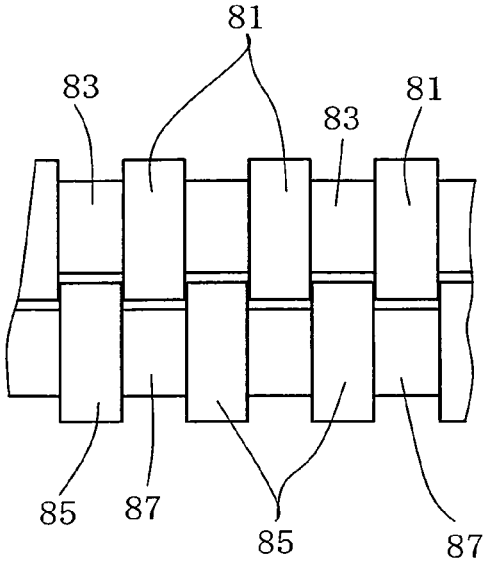
FIG. 16A is a front view as seen from line H-H of FIG. 15 showing contact members with the wood block removed for clarity.
Figure 16B:
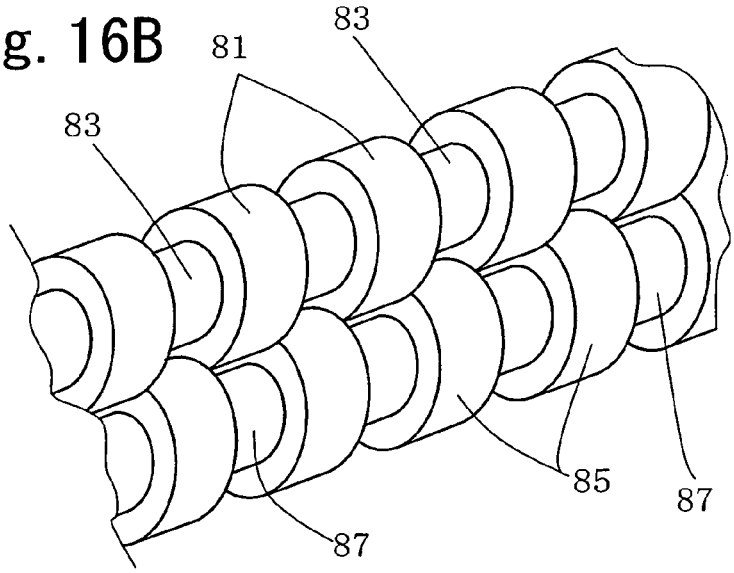
FIG. 16B is a perspective view showing the contact members of FIG. 16A.

Referring to FIGS. 15, 16A and 16B showing such modification, numeral 88 designates the backup apparatus and symbol R represents the paired backup carriages. A first rotatable shaft 83 having fixedly mounted thereof a first group of plural backup rolls 81 and a second rotatable shaft 87 having fixedly mounted thereof a second group of plural backup rolls 85 are disposed between the paired backup carriages R and on the opposite side of a wood block W held between the spindles 3 from the cutting edge of the veneer knife 105. As shown in FIGS. 16A and 16B, the backup rolls 81 of the first group and the backup rolls 85 of the second group are mounted on the respective shaft 83, 87 at a spaced interval so that a recessed space is formed between any two adjacent backup rolls. The backup rolls 81 and the backup rolls 85 are of substantially the same size and spaced and arranged in such a manner that a part of a roll of one group is inserted in a recessed space between any two adjacent rolls of the other group. As indicated above, the two groups of backup rolls 81, 85 are arranged in such a unit that relative position between the two sets of rolls remains unchanged and the rolls are movable together as a unit.

The shafts 83, 87 are rotatably supported by the backup carriages R through any suitable bearings and driven to rotate by servomotors such as 39. A ring member such as 29 and a rotary encoder such as 35 are provided for measuring the peripheral speed of a wood block W. As in the first embodiment, the knife carriage 101, the backup rolls 81, 85 are arranged around a wood block W being cut the veneer knife 105. The backup carriages R are movable in accordance with the movement of the knife carriage 101.

Figure 17:
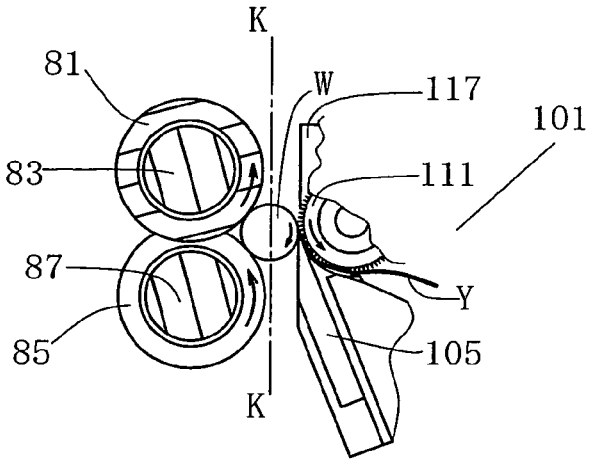
FIG. 17 is a side view showing the wood block being cut to a reduced diameter by the veneer knife in the modified embodiment of FIG. 15.

In this modification, the knife carriage 101 and the backup carriage R are moved toward the spin axis Q of the wood block W held between the spindles 3 in the same manner as in the case of the first embodiment during peeling operation of the veneer lathe. The backup rolls 81, 85 are in rolling contact intermittently with the periphery of the wood block W until the wood block W is substantially rounded. When the wood block W becomes substantially cylindrical by rounding, the backup rolls 81, 85 are kept in contact with the periphery of the wood block W and the points of contact of the backup rolls 81, 85 with the periphery of the wood block W are gradually moved closer to each other with a progressive decrease of the diameter of the wood block W, as shown in FIG. 17.

When the wood block W reaches a predetermined diameter, the spindles 3 are disengaged from the wood block ends and moved to their retracted positions. Wood block cutting by the veneer knife 105 is continued with the wood block W then supported by the driving discs 111 and the backup rolls 81, 85 and driven to rotate by the discs 111. FIG. 17 shows a state where the wood block W is cut already to a small diameter and the points of contact of the backup rolls 81, 85 with the periphery of the wood block W as seen in the side view have moved closer than in the case shown in FIG. 15. Thus, the wood block W can be continued to be cut while being supported successfully.

The diameter and the relative position of the backup rolls 81, 85 may be determined so that no part of the periphery of the backup rolls 81, 85 is moved beyond an imaginary vertical plane K-K (FIG. 17) passing through the spin axis Q of the wood block W which is then cut down to the desired minimum diameter.

In the above first and the modified embodiments, the spindles 3 are moved away from the opposite ends of a wood block when it has reached a predetermined diameter. According to the present invention, the spindles 3 do not necessarily have to be disengaged from the wood block ends.

That is, a pair of multiple spindles, e.g. double spindles of telescopic type each having a large-diameter outer spindle and a telescopically movable small-diameter inner spindle may be used. Both inner and outer spindles are used to support and rotate a wood block when the wood diameter is still large, but the outer large spindles are moved away from the wood block ends after the wood block diameter has reached a predetermined value so that the wood block is then supported by the inner small-diameter spindles. As a matter of course, a wood block cannot be peeled down to a core diameter smaller than the diameter of the inner spindles, but the wood block may be supported with stability by the backup rolls 27 and the backup blocks 61 or by the rolls 81, 85, so that the wood block is cut into veneer with the desired thickness without being bent or flexed by any external force produced during the wood block cutting operation.

In the above-described first and modified embodiments, cutting of a wood block is started with the wood block W supported and driven by spindles 3. When handling a wood block which has been previously rounded to a substantially cylindrical shape, however, the wood block cutting may be initiated with the wood block supported only by the backup rolls 27 and the backup blocks 61 or by the rolls 81, 85 together with the drive discs 111 without using the spindles 3.

In the above first and the modified embodiments, the knife carriage 101 and the backup carriages 17 or R are both moved toward the spin axis Q of a wood block W during the cutting operation. It may be so arranged, however, that the knife carriage 101 is set stationary and only the backup carriages 17 or R are moved toward the spin axis Q of the wood block W. Alternatively, the backup carriages 17 or R are set stationary and only the knife carriage 101 is moved toward the spin axis Q of the wood block. In either case, the carriage that is movable will be moved for a distance that is twice as large as the distance moved by the knife carriage 101 and the backup carriages 17 or R for each complete revolution of the wood block W in the case of the first or the modified embodiment.

Figure 18A:
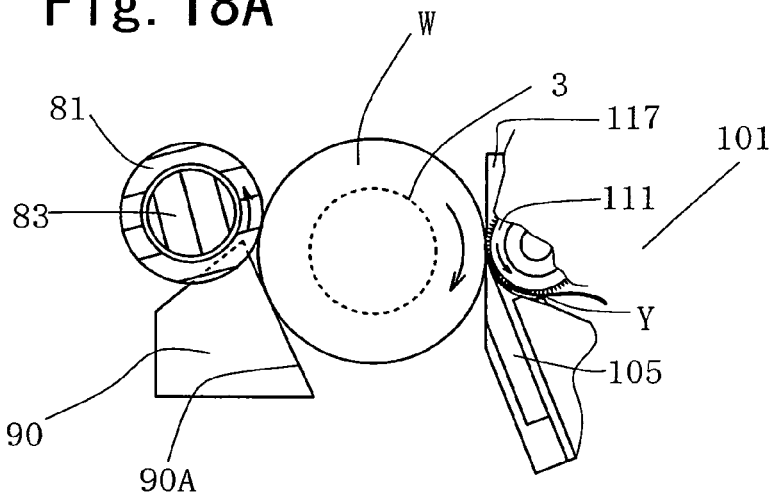
FIG. 18A is a fragmentary side view showing another modified embodiment of a veneer lathe according to the present invention.
Figure 18B:
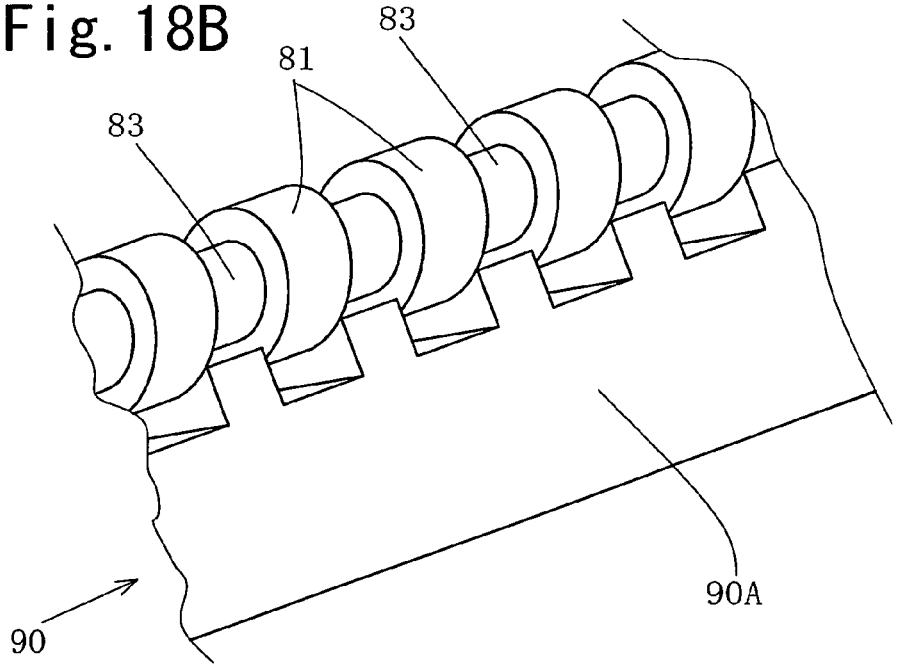
FIG. 18B is a perspective view showing contact members used in the veneer lathe of FIG. 18A.

In the modified embodiment described with reference to FIGS. 15, 16A and 16B, the contact members 81, 85 of the firs and the second groups are provided in the form of a roll contactable with the periphery of a wood block W in rolling contact for reducing the resistance against the rotation of the wood block. However, the contact members of one group may be provided in the form of a block having flat surface contactable with the wood block periphery in sliding contact, although the resistance is increased. For example, the rotatable shaft 87 and the backup rolls 85 of the second group in FIGS. 15, 16A and 16B may be replaced with a backup block 90 having contact surface 90A contactable with the wood block periphery. The backup block 90 is formed with a plurality of projections and a part of each projection is received in a recessed space between any two adjacent rolls 81 on the shaft 83 and recesses spaced so as to receive therein the rolls 81, as shown in FIG. 18B.

In this embodiment, as mentioned earlier herein, the wood block cutting for veneer peeling may be also accomplished by moving at least one of the knife carriage 101 and the backup member 89 toward the spin axis Q of wood block W for a predetermined distance for each complete revolution of the wood block W depending on the desired thickness of veneer to be peeled.

The time at which the spindles 3 are moved away from engagement with the wood block ends may be determined and the steps to take when cutting a wood block already rounded be performed as in the case described with reference to FIGS. 15, 16A and 16B.

A wood block being cut by the veneer knife 105 may be supported by using any additional contact member that is contactable with the peripheral surface of the wood block.

Figure 19:
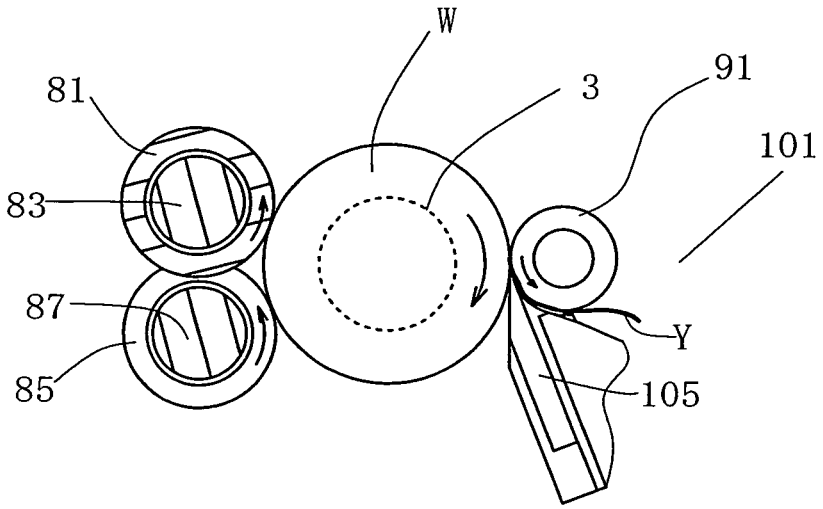
FIG. 19 is a fragmentary side view showing still another modified embodiment of a veneer lathe according to the present invention.

The veneer lathe according the above embodiment and the modifications has driving discs 111 for rotatably driving the wood block W from its periphery and the nose bars 117 for preventing lathe checks from being developed in the surface of veneer being peeled from the wood block. These discs 111 and the nose bars 117 may be substituted by a roller bar 91, as shown in FIG. 19, which is disposed in the same position of the driving discs 111 in the embodiment of FIG. 1 for performing the same functions as the discs 11 and also the nose bars 117. In this case, the outer periphery of the roller bar 91 may be indented for enhancing the transmission of driving force from the roller bar to the wood block W.

The following will describe a second embodiment according to the present invention with reference to FIGS. 20 through 27. In the second embodiment, the knife carriage 101, the frames such as 7, the first movable contact members, i.e. the backup rolls 27 and the mechanism for moving the backup rolls 27 are substantially the same as the counterparts of the first embodiment. Those parts and elements which are common to the first and second embodiments are designated by the same reference numerals and the detailed description thereof will be omitted. The second embodiment differs from the first embodiment in the structure and arrangement of the second contact members.

Figure 20:
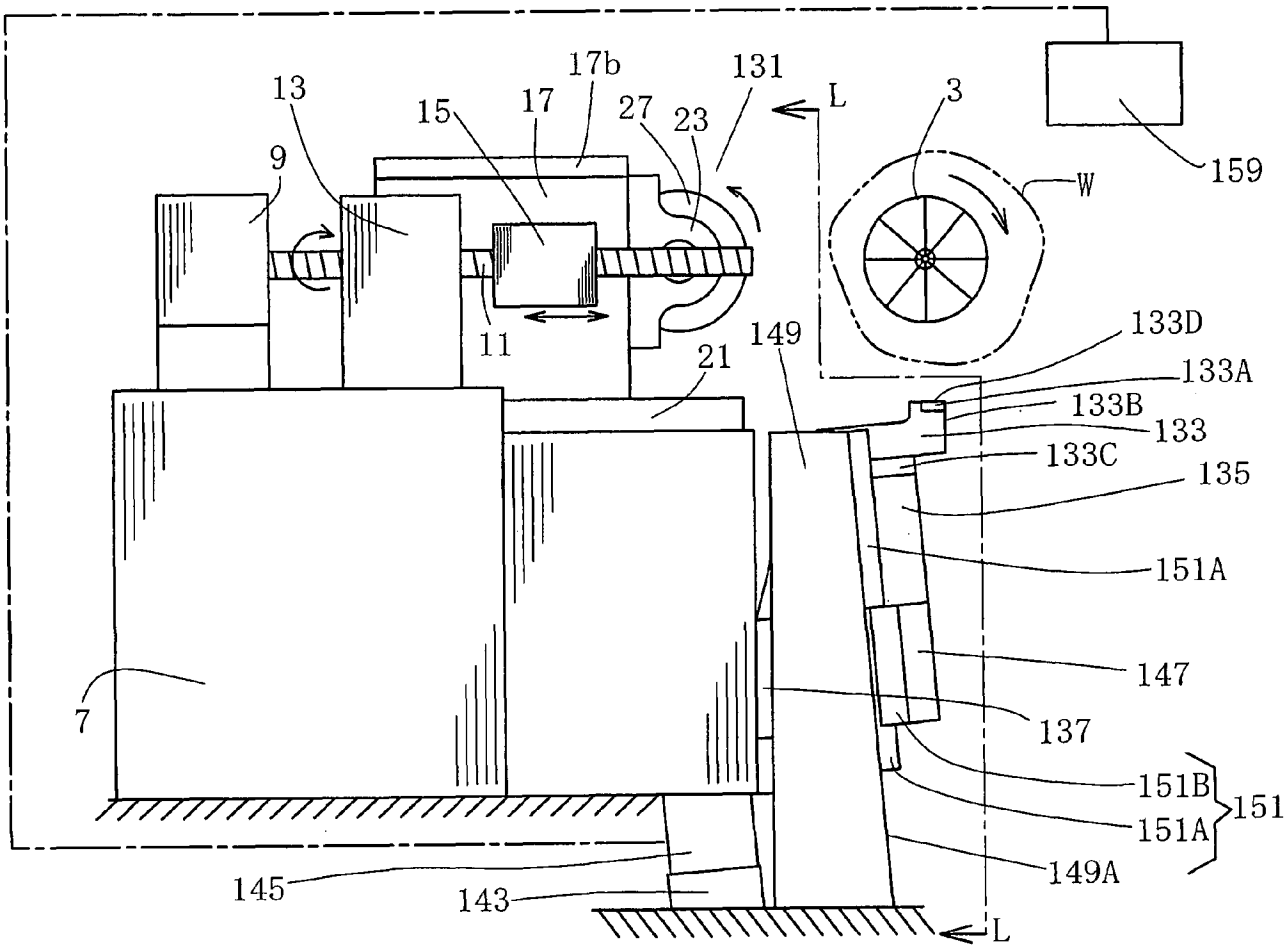
FIG. 20 is a fragmentary side view showing a second embodiment of a veneer lathe according to the present invention.
Figure 21:
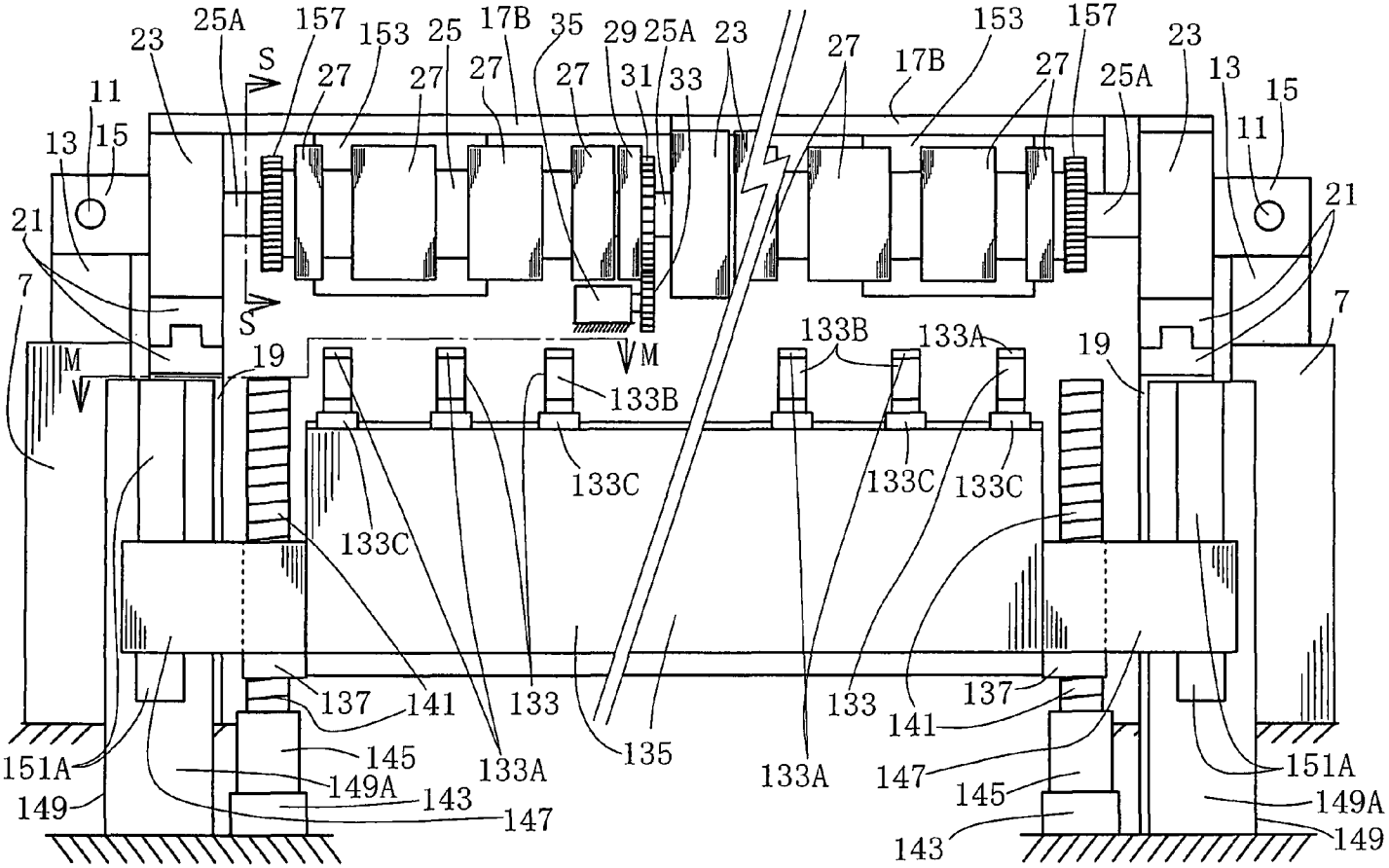
FIG. 21 is a front view as seen from line L-L of FIG. 20.
Figure 23:
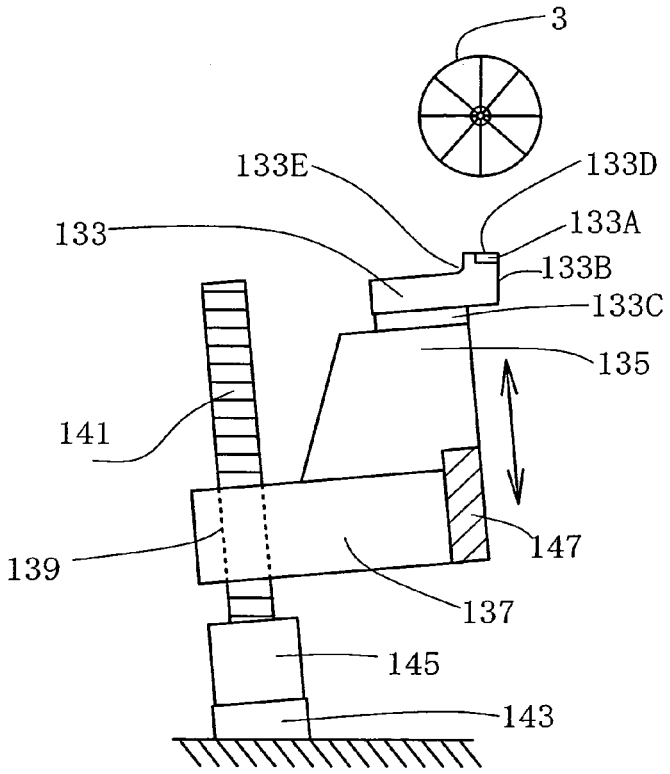
FIG. 23 is a partial sectional fragmentary side view as seen from line N-N of FIG. 22, showing a contact member in its lowered position.

Referring firstly to FIG. 20, numeral 131 designates the backup apparatus 131 corresponding to the backup apparatus 5 of FIG. 1. Numeral 133 designate a plurality of second slide-type contact members or backup blocks (only one being shown) corresponding to the backup blocks 61 of the first embodiment of FIG. 1. As shown in FIG. 21, each backup block 133 is fixedly mounted to a support seat 133C which is in turn fixed to a movable mounting plate 135. The backup block 133 has at the top thereof an insert 133A made of a wear-resistant metal, and the top of the backup block 133 including the insert 133A is formed horizontally flat. The backup block 133 has an end surface 133B on the side thereof adjacent to the knife carriage 101 (not shown), which is formed vertically flat. As shown in FIG. 23, the backup block 133 has a cutaway 133E which is recessed from the top of the block. As shown in FIG. 21, the thickness of the backup blocks 133 as measured in the axial direction of the spindles 3 is smaller than a space formed between any two adjacent backup rolls 27, and the backup blocks 133 are disposed at positions corresponding to the spaces so that that each backup block 133 may enter into its corresponding space, as in the case of the backup blocks 61 of the first embodiment of FIG. 1.

Figure 22:
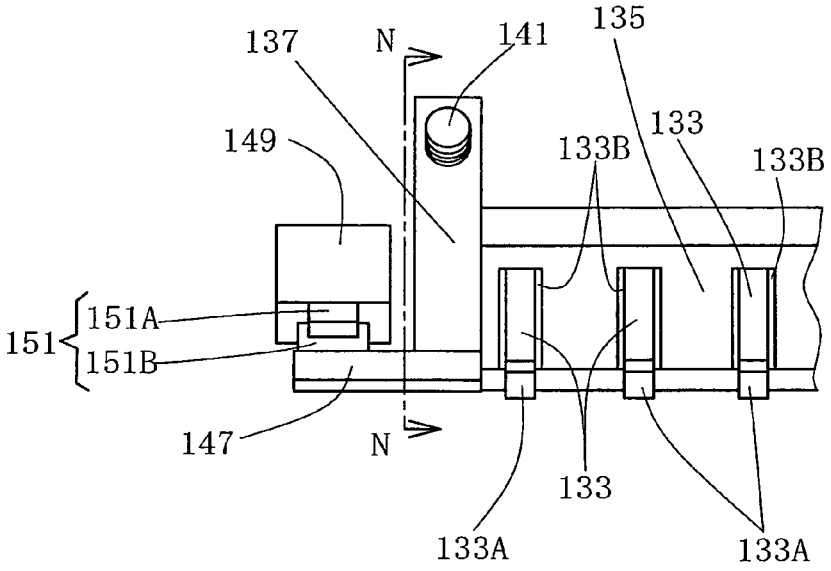
FIG. 22 is a fragmentary plan view as seen from line M-M of FIG. 21.

As shown in FIG. 21, the movable mounting plate 135 to which the backup blocks 133 are mounted through the support seats 133C is disposed extending along the spin axis Q of a wood block W held between the spindles 3 for a distance corresponding to the axial length of the wood block W. First connecting members 137 are fixed to the opposite ends of the mounting plate 135, each having formed therethrough an internally threaded hole 139. There is provided a pair of leadscrews 141, each inserted through the first connecting member 137 in engagement with the internal thread in the hole 139. The leadscrew 41 is connected at the lower end thereof to a servomotor 145 fixed to a base 143. Each servomotor 145 has an absolute rotary encoder (not shown) for determining the distance between the top surface of the backup blocks 133 and the spin axis Q of a wood block W held between the spindles 3, which spin axis Q coincides with the axis of rotation of the spindles 3. The leadscrew 141 is inclined with an inclination angle of about 5 degrees in such a disposition that the top of the leadscrew is farther away from the knife carriage 101 than the bottom. As shown in FIGS. 22 and 23, a second connecting member 147 is fixed to each first connecting member 137 for movement therewith.

Numeral 149 (FIGS. 20 and 21) designates a pair of column supports disposed at positions adjacent to the outer ends of the respective second connecting members 147. As shown in FIG. 20, the surface 149A of each column support 149 on the side facing the knife carriage 101 is formed with an inclination of about 5 degrees in the same direction as the leadscrews 141. A linear bearing 151 is provided which has a stationary linear base 151A fixedly mounted to the inclined surface 149A of each column support 149 and a slide 151B which is movable relative to the base 151A and to which the second connecting member 147 is fixed.

In such an arrangement, the rotation of the leadscrews 141 driven reversibly by the servomotors 145 causes the connecting members 137 and hence the mounting plate 135 and the backup blocks 133 mounted on the plate 135 to move along the inclined surfaces 149A of the column supports 149, as indicated by double-headed arrow (FIG. 23). The movement of the mounting plate 135 is guided linearly along the inclined surfaces 149A by the linear bearings 151.

Figure 24:
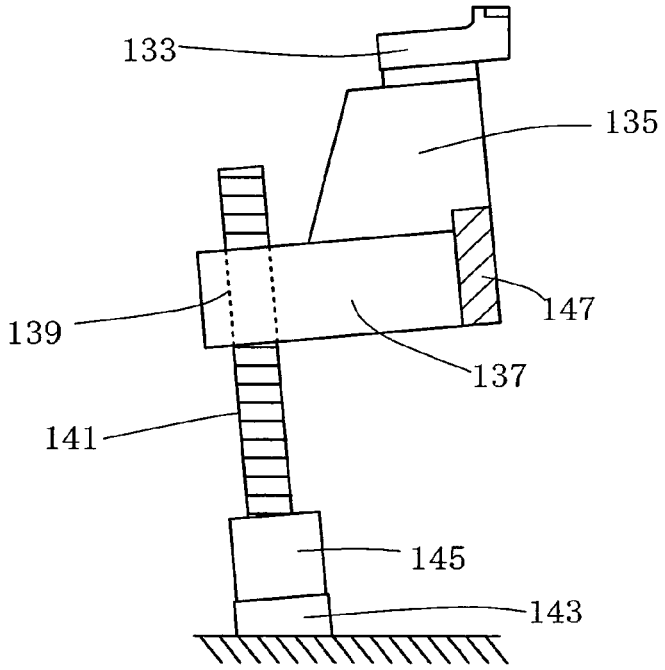
FIG. 24 is a view similar to FIG. 23, but showing the backup member of FIG. 23 in its elevated position.

Referring to FIG. 23, when the mounting plate 135 (not shown) is placed in its lowermost position, the backup block 133 is positioned such that the point on the insert 133A that is about 30 mm spaced from the corner edge of the insert 133A adjacent to the vertical end surface 133B is located just below the spin axis Q of the wood block W held between the spindles. When the mounting plate 135 is elevated to its uppermost position as shown in FIG. 24, on the other hand, the backup block 113 is positioned such that the above corner edge of the insert 133A is located just below the spin axis Q of the wood block W. As appreciated readily, such difference in position of the backup block 133 when the mounting plate 135 is in lowered and elevated positions is due to the disposition of the leadscrews 141 with the inclination of about 5 degrees.

In FIG. 23, the vertical distance between the top surface 133D of the insert 133A of the backup block 133 and the spin axis Q of a wood block held between the spindles 3 that coincides with the axis of rotation of the spindles 3 corresponds to the maximum peelable diameter of a wood block when it is cut by the veneer lathe according to the present second embodiment.

Figure 25:
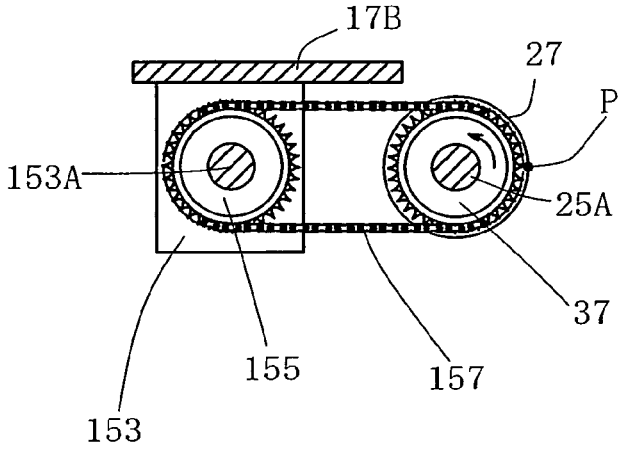
FIG. 25 is a partial sectional fragmentary view as seen form line S-S of FIG. 21.

Referring back to FIG. 20, the backup apparatus 131 includes a plurality of backup rolls 27 which are substantially identical to the counterparts used in the first embodiment of FIG. 1. As shown in FIG. 25, a pair of motors 153 (only one motor being shown) for driving the backup rolls 27 is fixedly mounted to the bottom of the horizontal plate 18B of the box-shaped mounting frame 18 (not shown). Sprocket wheels 155 and 37 are fixed on the output shaft 153A of each motor 153 and one end 25A of the shaft 25, respectively, and an endless chain 157 is trained between the two sprocket wheels 155 and 37. Thus, the backup rolls 27 are driven to rotate in arrow direction (FIG. 20) by the motors 153 through the chains 157. As indicated earlier, the rest of the structure of the backup apparatus 131 except the second contact members or the backup blocks 133 and their related parts and devices are substantially the same as the counterpart of the first embodiment of FIG. 1.

In cutting a wood block W to peel veneer with a thickness T, the control unit 159 generates command signals to the servomotors 104 so that the leadscrews 103 are rotated to move the knife carriage 101 toward the spin axis Q of the wood block W held between the spindles 3 for a distance corresponding to the desired thickness T of veneer for each complete revolution of the spindles 3. The absolute rotary encoders connected to the servomotors 104 determine the current distance between the cutting edge of the veneer knife 105 and the spin axis Q of the wood block W and generates a signal indicative of such distance to the control unit 159. The control unit 159 also receives detection signals from the absolute rotary encoders connected to the servomotors 9 and 145 indicative of the distance between the point of contact P of the backup rolls 27 with the periphery of the wood block W and the spin axis Q of the wood block W and also the distance between the top surface 133D of the insert 133A of the backup block 133 and the spin axis Q of the wood block W, respectively.

Based on the information of such distances provided by the encoders, the control unit 159 controls the operation of the servomotors 9 and 145 in such a way that the positional relation among the cutting edge of the continuously advancing veneer knife 105, the point of contact P of the backup rolls 27 with the periphery of the wood block W and the top surface 133D of the backup blocks 133 with respect to the imaginary spiral curve as described with reference to FIG. 9 is maintained during wood block cutting operation.

Cutting of a wood block for production of veneer with the desired thickness in the present second embodiment is accomplished as follows.

Figure 26:
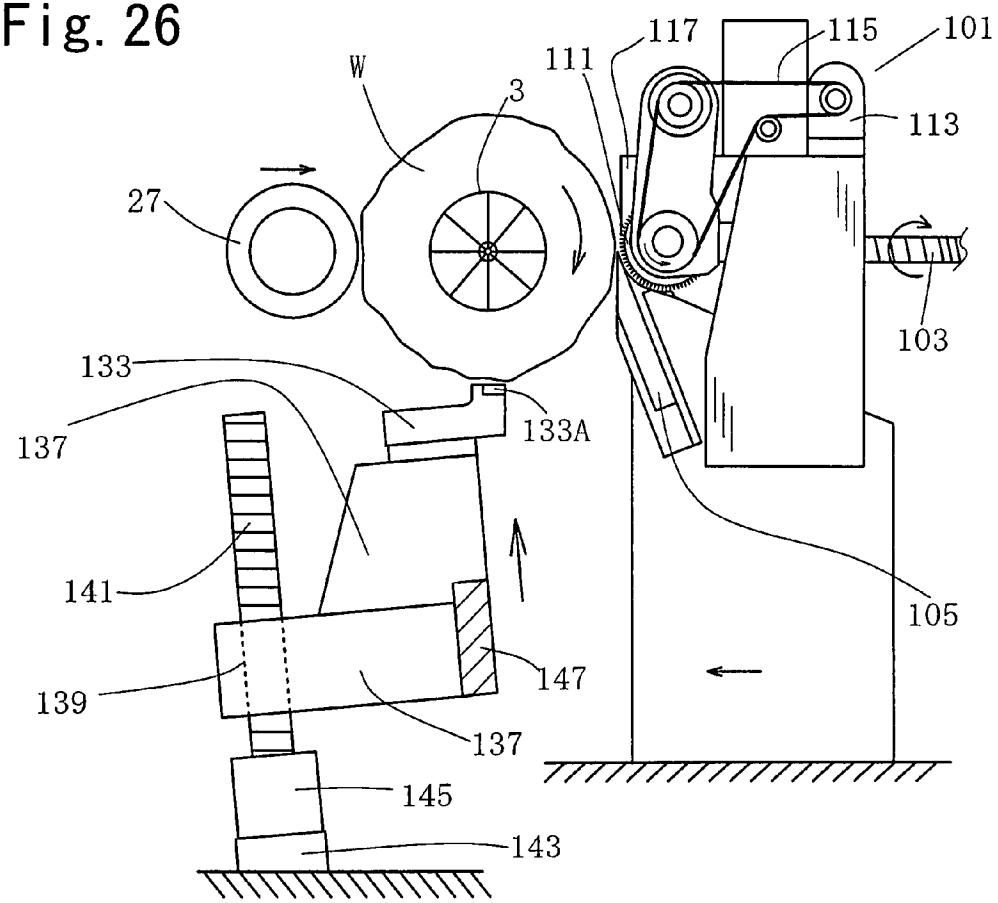
FIGS. 26 and 27 are side views showing two different stages of a wood block being cut by veneer knife of the veneer lathe of FIG. 20.

Firstly, the lathe operator enters data of the desired thickness T of veneer Y to be peed from the wood block W into the control unit 159. Then, as in the case of the first embodiment, the wood block W is set and held between the spindles 3 and the knife carriage 101 is moved away from the wood block W to a position where the cutting edge of the veneer knife 105 on the knife carriage 101 is sufficiently clear of the periphery of the wood block W when it is rotated, as shown in FIG. 26. Simultaneously, the backup rolls 27 and the backup blocks 133 are moved to the positions where they are clear of the wood block W, as shown in FIG. 26, and also the circumferential periphery of the backup rolls 7 and the top surfaces 133A of the backup blocks 133 lie on an imaginary spiral curve as in the case of the first embodiment. The motor 113 for driving the discs 111 is started previously.

With the knife carriage 101, the backup rolls 27 and the backup blocks 133 thus set in their initial positions, the control unit 79 starts the servomotors 4 thereby to drive the wood block Won its spin axis Q. Simultaneously, the servomotors 104, 9 and 145 are started to move the knife carriage 101, the backup rolls 27 and the backup members 133 toward the spin axis Q of the wood block W, respectively, while maintaining the positional relation with respect to the imaginary spiral curve. Thus, veneer Y with the desired thickness T is peeled by the veneer knife 105 from the rotating wood block W.

As the wood block W has become substantially cylindrical by rounding, a continuous ribbon of veneer Y begins to be cut from the wood block W. As the cutting further proceeds and the diameter of the wood block W is reduced to such a predetermined extent that the cutting edge of the veneer knife 105 has moved close to the spindles 3, the hydraulic cylinders (not shown) for the spindles 3 are operated to retract the spindles 3 away from engagement with the wood block ends. Cutting is continued with the wood block W then supported by the backup rolls 27 and the backup blocks 133 and driven to rotate only by the driving discs 111. As in the case of the first embodiment, the rotating speed of the wood block W is figured out by the control unit 159 based on the current distance between the cutting edge of the veneer knife 105 and the spin axis Q of the wood block W that is measured by the absolute rotary encoders connected to the servomotors 104 and the rotating speed of the ring member 29 set in rolling contact with the wood block W in terms of the number of revolutions per unit time.

Figure 27:
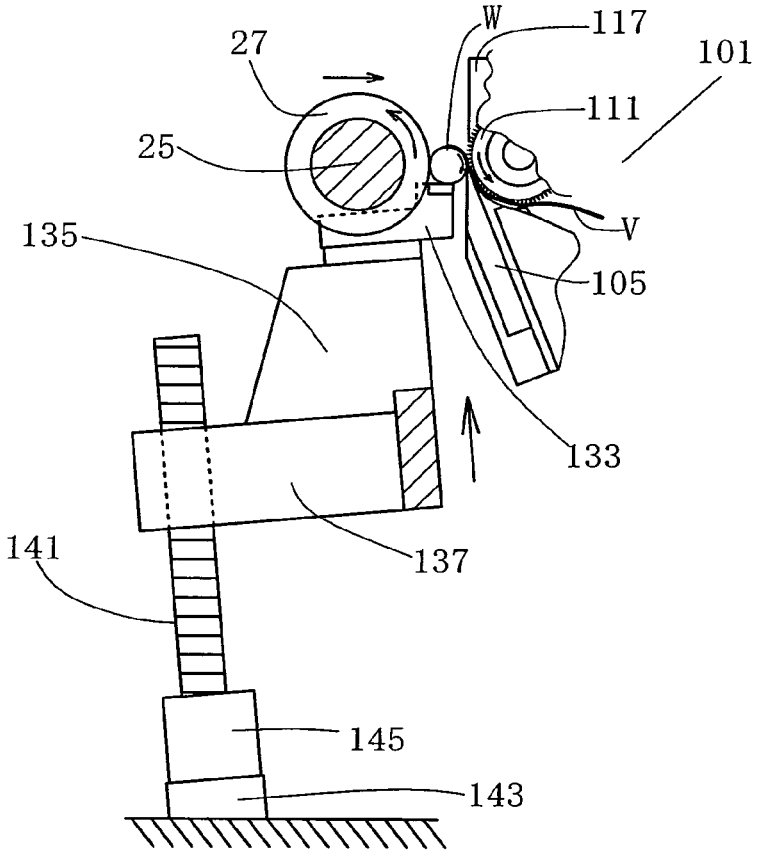

When the diameter of the wood block W is further decreased to an extent as shown in FIG. 27, a part of each backup block 133 enters into a space between any two adjacent backup rolls 27, so that the wood block W continues to be supported by the backup rolls 27 and the backup blocks 133 and, therefore, cutting is continued further until a predetermined diameter is reached.

As described earlier, the leadscrews 141 are disposed with an inclination of about 5 degrees for causing the backup blocks 133 to be moved leftward slightly as seen in FIG. 23 while being moved upward. The inclination of the leadscrews 141 is provided so that the point on the top surface 133D of the insert 133A at which the top surface 133D is in contact with the periphery of the rotating wood block W just below the spin axis Q of the block W is shifted to the aforementioned corner edge of the insert 133A when the backup block 133 is moved to its uppermost position shown in FIG. 24. By so moving the backup block 133, the cutting edge of the veneer knife 105 can be moved closer to the spin axis Q of the wood block W without interfering with the backup block 133, with the result that the wood block W may be cut to a still smaller diameter than in a case wherein the leadscrews 141 are provided upright with no inclination. Additionally, the cutaway 133E in the backup block 133 performs the same function as the cutaway 61C in the backup block 61 of the first embodiment. That is, the presence of the cutaway 133E permits the backup block 133 to enter into a space between the backup rolls 27 deeper than in a case no such cutaway is provided, with the result that the wood block W can be peeled down to a core stick with a small diameter.

In the above-described second embodiment, it may be so arranged that one of the knife carriage 101 and the backup carriages 17 is/are set stationary while the other is moved toward the spin axis Q of the wood block W.

Although the invention has been described in detail for the purpose of illustration, it is to be understood that such detail is solely for that purpose and that variations can be made therein by those skilled in the art without departing from the spirit and scope of the invention.

What is claimed is:

1. A veneer lathe comprising:

a pair of rotatable spindles for holding therebetween a generally cylindrical wood block at the opposite ends thereof;

a spindle drive mechanism for driving at least one of the spindles thereby to rotate the wood block on spin axis thereof;

a movable knife carriage having a veneer knife with a cutting edge engageable with the wood block so as to cut thereinto and a wood block drive mechanism disposed adjacently to the cutting edge for driving the wood block from the periphery thereof;

a knife carriage drive mechanism for moving the knife carriage toward the spin axis of the wood block;

a first group of a plurality of movable first contact members axially spaced away from each other parallel to the spin axis of the wood block held between the spindles so as to form at least one first space between adjacent first contact members and each first contact member having a contact portion contactable with the periphery of the wood block;

a second group of a plurality of movable second contact members axially spaced away from each other parallel to the spin axis of the wood block held between the spindles so as to form at least one second space between adjacent second contact members and each second contact member having a contact portion contactable with the periphery of the wood block, the contact members of the first and the second groups being spaced and arranged in such a way that at least a part of at least one of the first contact members enters into the at least one second space when the first group of contact members and the second group of contact members are moved close together;

a first drive mechanism for moving the contact members of the first group;

a second drive mechanism for moving the contact members of the second group;

a first detecting mechanism for determining current radius of the wood block being cut;

a second detecting mechanism for determining time required for the wood block to make a complete revolution; and a control unit operable to control the operation of the knife carriage drive mechanism so that knife carriage is moved for a predetermined distance toward the spin axis of the wood block in the time determined by the second detecting mechanism and also to control the operation of the first drive mechanism and the second drive mechanism so that the contact members of the first and the second groups are moved toward the spin axis of the wood block with the contact portions thereof kept lying on an imaginary spiral curve that extends from the cutting edge of the veneer knife in the direction in which the wood block is rotated for a distance corresponding to a substantially complete revolution of the wood block as seen in transverse section of the wood block, said imaginary spiral curve being a part of an imaginary Archimedean spiral which is determined by said predetermined distance moved by the knife carriage and represents a path of the cutting edge of the veneer knife as seen in transverse section of the wood block during wood block cutting.

2. A veneer lathe according to claim 1, wherein the first contact members are disposed on an opposite side of the wood block from the cutting edge of the veneer knife and the second contact members are approximately 90 degrees around the spin axis of the wood block from the cutting edge and the first contact members.

3. A veneer lathe according to claim 2, wherein the contact members of the second group includes a contact member in the form of a block having a top surface contactable with the periphery of the wood block in sliding contact and a substantially vertical surface formed on the side of the block adjacent to the veneer knife.

4. A veneer lathe according to claim 2, wherein the contact members of the second group includes a contact member in the form of a block having a top surface contactable with the periphery of the wood block in sliding contact and a cutaway surface formed on the side of the block adjacent to contact members of said one of the first and the second groups.

5. A veneer lathe comprising:

a pair of rotatable spindles for holding therebetween a generally cylindrical wood block at the opposite ends thereof;

a spindle drive mechanism for driving at least one of the spindles thereby to rotate the wood block on spin axis thereof;

a movable knife carriage having a veneer knife with a cutting edge engageable with the wood block and a wood block drive mechanism disposed adjacently to the cutting edge for driving the wood block from periphery thereof;

a knife carriage drive mechanism for moving the knife carriage toward the spin axis of the wood block;

a plurality of first contact members and a plurality of second contact members disposed on different sides of the wood block from the cutting edge of the veneer knife and each contact member having a contact portion contactable with periphery of the wood block, the first contact members being axially spaced away from the second contact members along the spin axis of the wood block, said first contact members being axially spaced away from each other parallel to a spin axis of the wood block so as to form at least one first space between any two adjacent first contact members, said second contact members being axially spaced away from each other parallel to the spin axis of the wood block so as to form at least one second space between any two adjacent second contact members and arranged in such a way that at least a part of the first contact members is selectively inserted in the at least one second space;

a drive mechanism for moving the first and the second contact members together;

a first detecting mechanism for determining current radius of the wood block being cut;

a second detecting mechanism for determining the time required for the wood block to make a complete revolution; and a control unit operable to control the operation of the knife carriage drive mechanism so that knife carriage is moved for a predetermined distance toward the spin axis of the wood block in the time determined by the second detecting mechanism and also to control the operation of the drive mechanism so that the first contact members and the second contact members are moved together toward the spin axis of the wood block with the contact portions thereof kept lying on an imaginary spiral curve that extends from the cutting edge of the veneer knife as seen in transverse section of the wood block in the direction in which the wood block is rotated for a distance corresponding to a substantially complete revolution of the wood block, said imaginary spiral curve being a part of an imaginary Archimedean spiral which is determined by said predetermined distance moved by the knife carriage and represents a path of the cutting edge of the veneer knife as seen in transverse section of the wood block during wood block cutting.

6. A veneer lathe comprising:

a knife carriage having a veneer knife with a cutting edge engageable with the wood block and a wood block drive mechanism disposed adjacently to the cutting edge for driving the wood block to rotate on its spin axis from the periphery thereof;

a contact member carriage having mounted thereon a first group of a plurality of first contact members and a second group of a plurality of second contact members each of the first and second contact members having a contact portion contactable with periphery of the wood block, the first and the second contact members being laterally spaced away from each other along the spin axis of the wood block so as to form at least one first space between every two adjacent contact members of the first contact members and a second space between every two adjacent contact members of the second space, and arranged in such a way that at least a part of the contact member of the first group is selectively insertable into the respective second space between adjacent contact members of the second group;

a first drive mechanism for moving at least one of the knife carriage and the contact member carriage;

a second drive mechanism for moving the contact members of at least one of the two groups so that said at least a part of the contact member of one group is inserted into the space between any two adjacent contact members of the other group;

a detecting mechanism determining current radius of the wood block being cut and generating a signal indicative of such current radius; and a control unit operable in response to the signal from the detecting mechanism to control of the operation of the first and the second drive mechanisms so that the contact portions of the first and the second contact members are kept in contact engagement with the periphery of the wood block being cut by the veneer knife and also that said at least a part of the contact member of one group is inserted into the space between any two adjacent contact members of the other group when the current radius of the wood block determined by the detecting mechanism reaches a predetermined value.

7. A veneer lathe comprising:

a knife carriage having a veneer knife with a cutting edge engageable with the wood block and a wood block drive mechanism disposed adjacently to the cutting edge for driving the wood block to rotate on its spin axis from the periphery thereof;

a contact member carriage disposed on opposite side of the wood block from the knife carriage and having mounted thereon a plurality of first contact members and a plurality of second contact members each contact member having a contact portion contactable with periphery of the wood block, the first contact members being movable together as a unit, the second contact members being movable together as a unit, the first contact members being spaced away from each other along the spin axis of the wood block so as to form at least one first space between adjacent first contact members, the second contact members being spaced away from each other along the spin axis of the wood block so as to form a second space between adjacent second contact members, wherein the first and second contact members are arranged in such a way that at least a part of each the first contact members is selectively passed into the second space between respective second contact members as the wood block nears a minimum radius; and a drive mechanism for moving at least one of the knife carriage and the contact member carriage.

8. A veneer lathe according to claim 1, wherein:

the spindle drive mechanism is servomotors that drive the spindles;

the knife carriage drive mechanism is a lead screw driven by servomotor that drives the knife carriage;

the first drive mechanism is a lead screw driven by servomotor that drives the first contact members;

the second drive mechanism is a linear bearing upon a slide that is moved by a lead screw and servomotor for moving the second contact members; and the control unit, the first detecting mechanism, and the second detecting mechanism include electronic processing hardware connected to encoders.

9. A veneer lathe according to claim 1, wherein when the first group of contact members and the second group of contact members are moved close to each other, at least a part of at least two of the second contact members each enters the respective at least one first space.

* * * * *